US010054866B2

(12) United States Patent
Tanaka et al.

(10) Patent No.: US 10,054,866 B2
(45) Date of Patent: Aug. 21, 2018

(54) TONER

(71) Applicant: CANON KABUSHIKI KAISHA, Tokyo (JP)

(72) Inventors: Masatake Tanaka, Yokohama (JP); Nobuhisa Abe, Susono (JP); Hidekazu Fumita, Gotemba (JP); Masashi Kawamura, Yokohama (JP); Shiro Kuroki, Suntou-gun (JP); Kenji Ookuba, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/486,585

(22) Filed: Apr. 13, 2017

(65) Prior Publication Data

US 2017/0299972 A1 Oct. 19, 2017

(30) Foreign Application Priority Data

Apr. 19, 2016 (JP) ..... 2016-084001

(51) Int. Cl.
*G03G 9/093* (2006.01)
*G03G 9/087* (2006.01)
*G03G 9/08* (2006.01)

(52) U.S. Cl.
CPC ..... *G03G 9/09328* (2013.01); *G03G 9/0819* (2013.01); *G03G 9/0821* (2013.01); *G03G 9/0825* (2013.01); *G03G 9/08708* (2013.01); *G03G 9/08711* (2013.01); *G03G 9/08755* (2013.01); *G03G 9/08786* (2013.01); *G03G 9/08788* (2013.01)

(58) Field of Classification Search
CPC ..... G03G 9/08755; G03G 9/08786; G03G 9/08788; G03G 9/08708; G03G 9/08711; G03G 9/0821; G03G 9/09328
See application file for complete search history.

(56) References Cited

U.S. PATENT DOCUMENTS 6,627,374 B2 9/2003 Fumita et al.
6,835,521 B2 12/2004 Tsuji et al.
(Continued)

FOREIGN PATENT DOCUMENTS

EP 3236318 A1 * 10/2017
JP 2009-133937 6/2009
(Continued)

*Primary Examiner* — Christopher D Rodee
(74) *Attorney, Agent, or Firm* — Fitzpatrick Cella Harper and Scinto

(57) ABSTRACT

A toner having a toner particle containing a binder resin and a crystalline material, wherein when "a" is an endothermic quantity deriving from the crystalline material in a DSC of the toner and "b" is an endothermic quantity deriving from the crystalline material in a DSC of the toner that has been held for 10 hours in an environment with a temperature of 55° C. and a humidity of 8% RH, the "a" and "b" satisfy a relationship $a/b \geq 0.85$; in a dynamic viscoelastic measurement of a non-melt-molded pellet of the toner, the toner has a temperature range A for which $G'' \leq 1 \times 10^5$ Pa and tan $\delta < 1$ are satisfied; and in a dynamic viscoelastic measurement of a melt-molded pellet of the toner, the toner has a temperature range B for which tan $\delta > 1$ is satisfied within the temperature range A.

8 Claims, 2 Drawing Sheets

(56) References Cited

U.S. PATENT DOCUMENTS

| | | | |
|---|---|---|---|
| 6,951,704 | B2 | 10/2005 | Tsuji et al. |
| 7,611,816 | B2 | 11/2009 | Tsuji et al. |
| 7,833,685 | B2 | 11/2010 | Tanaka et al. |
| 8,247,147 | B2 | 8/2012 | Abe et al. |
| 8,377,616 | B2 | 2/2013 | Tani et al. |
| 8,545,133 | B2 | 10/2013 | Fumita et al. |
| 8,628,899 | B2 | 1/2014 | Kawamura et al. |
| 8,815,484 | B2 | 8/2014 | Tanaka et al. |
| 8,822,120 | B2 | 9/2014 | Abe et al. |
| 8,828,639 | B2 | 9/2014 | Kamikura et al. |
| 8,916,319 | B2 | 12/2014 | Ikeda et al. |
| 8,940,467 | B2 | 1/2015 | Hashimoto et al. |
| 9,158,216 | B2 | 10/2015 | Shimano et al. |
| 9,366,981 | B2 | 6/2016 | Yamawaki et al. |
| 9,377,705 | B2 | 6/2016 | Shimano et al. |
| 9,383,668 | B2 | 7/2016 | Noji et al. |
| 9,500,972 | B2 | 11/2016 | Tanaka et al. |
| 9,599,919 | B2 | 3/2017 | Isono et al. |
| 9,658,549 | B2 | 5/2017 | Tanaka et al. |
| 2010/0035171 | A1 | 2/2010 | Watanabe et al. |
| 2014/0255840 | A1 | 9/2014 | Sekiguchi et al. |
| 2014/0356779 | A1 | 12/2014 | Hasegawa et al. |
| 2014/0377697 | A1 | 12/2014 | Nishiura et al. |
| 2015/0004539 | A1 | 1/2015 | Watanabe et al. |
| 2015/0153669 | A1 | 6/2015 | Yoshida et al. |
| 2015/0261110 | A1 | 9/2015 | Nakagawa et al. |
| 2015/0370189 | A1 | 12/2015 | Tanaka et al. |
| 2016/0246192 | A1 | 8/2016 | Yoshida et al. |
| 2016/0259259 | A1* | 9/2016 | Ueda ..... G03G 9/08786 |
| 2016/0299446 | A1 | 10/2016 | Karoki et al. |
| 2016/0299447 | A1 | 10/2016 | Masumoto et al. |
| 2016/0334727 | A1 | 11/2016 | Tanaka et al. |
| 2016/0349646 | A1 | 12/2016 | Yoshida et al. |
| 2017/0010551 | A1* | 1/2017 | Matsushima ..... G03G 9/08755 |
| 2017/0045835 | A1* | 2/2017 | Hirano ..... G03G 15/0121 |
| 2017/0052465 | A1 | 2/2017 | Shimano et al. |
| 2017/0060011 | A1 | 3/2017 | Nakagawa et al. |
| 2017/0123333 | A1 | 5/2017 | Kuroki et al. |

FOREIGN PATENT DOCUMENTS

| | | | |
|---|---|---|---|
| JP | 2013-080112 | 5/2013 | |
| JP | 2014-174262 | 9/2014 | |
| JP | 2015-045669 | 3/2015 | |
| JP | 2016-009173 | 1/2016 | |
| WO | WO-2016098616 A1 * | 6/2016 | ..... C08G 63/12 |

* cited by examiner

TONER

BACKGROUND OF THE INVENTION

Field of the Invention

The present invention relates to a toner used in image-forming methods such as electrophotographic methods, electrostatic recording methods, and toner jet methods.

Description of the Related Art

In recent years, higher speeds and a lower power consumption have been required of printers and copiers and the development has been required of toner that exhibits an excellent low-temperature fixability and an excellent hot offset resistance. To respond to these demands, several methods that control the viscoelasticity of toner compositions have been proposed.

A toner is disclosed in Japanese Patent Application Laid-open No. 2009-133937 that has an excellent cold offset resistance and an excellent hot offset resistance due to the presence, in dynamic viscoelastic measurements on the toner, of peak temperatures for the tan δ value at 50° C. to 100° C. and 130° C. to 180° C.

A toner is disclosed in Japanese Patent Application Laid-open No. 2015-045669 that has an excellent cold offset resistance, an excellent heat-resistant storability, and an excellent hot offset resistance due to the formation of a shell layer of a thermosetting resin and due to, in dynamic viscoelastic measurements on the toner, a tan δ at 120° C. smaller than 1, a tan δ at 200° C. larger than 1, and a maximum value-to-minimum value ratio for tan δ at 120° C. to 200° C. of at least 2.5.

SUMMARY OF THE INVENTION

The toners described in Japanese Patent Application Laid-open Nos. 2009-133937 and 2015-045669 do have an improved cold offset resistance and an improved hot offset resistance, but the problems of image dropout and reduced gloss still remain.

The present invention provides a toner in which an increased gloss co-exists with a suppression of image dropout.

The present invention relates to a toner comprising a toner particle containing a binder resin and a crystalline material, wherein when "a" is an endothermic quantity deriving from the crystalline material in a differential scanning calorimetric measurement of the toner and "b" is an endothermic quantity deriving from the crystalline material in a differential scanning calorimetric measurement of the toner that has been held for 10 hours in an environment with a temperature of 55° C. and a humidity of 8% RH, the "a" and "b" satisfy a relationship $a/b \geq 0.85$; in a dynamic viscoelastic measurement of a non-melt-molded pellet of the toner, the toner has a temperature range A for which $G'' \leq 1 \times 10^5$ Pa and tan $\delta < 1$ are satisfied; and in a dynamic viscoelastic measurement of a melt-molded pellet of the toner, the toner has a temperature range B for which tan $\delta > 1$ is satisfied within the temperature range A: the dynamic viscoelasticity is measured using a rotational parallel plate rheometer in temperature sweep mode in a temperature range of 50° C. to 160° C. at a temperature ramp rate of 2.0° C./minute and an oscillation frequency of 1.0 Hz (6.28 rad/s).

The present invention is also a toner comprising a toner particle containing a binder resin and a crystalline material, wherein a degree of crystallinity of the crystalline material as determined from a differential scanning calorimetric measurement of the toner is at least 85%; in a dynamic viscoelastic measurement of a non-melt-molded pellet of the toner, the toner has a temperature range A for which $G'' \leq 1 \times 10^5$ Pa and tan $\delta < 1$ are satisfied; and in the dynamic viscoelastic measurement of a melt-molded pellet of the toner, the toner has a temperature range B for which tan $\delta > 1$ is satisfied within the temperature range A: the dynamic viscoelasticity is measured using a rotational parallel plate rheometer in temperature sweep mode in a temperature range of 50° C. to 160° C. at a temperature ramp rate of 2.0° C./minute and an oscillation frequency of 1.0 Hz (6.28 rad/s).

Further features of the present invention will become apparent from the following description of exemplary embodiments with reference to the attached drawings.

DESCRIPTION OF THE EMBODIMENTS

Figure 1:
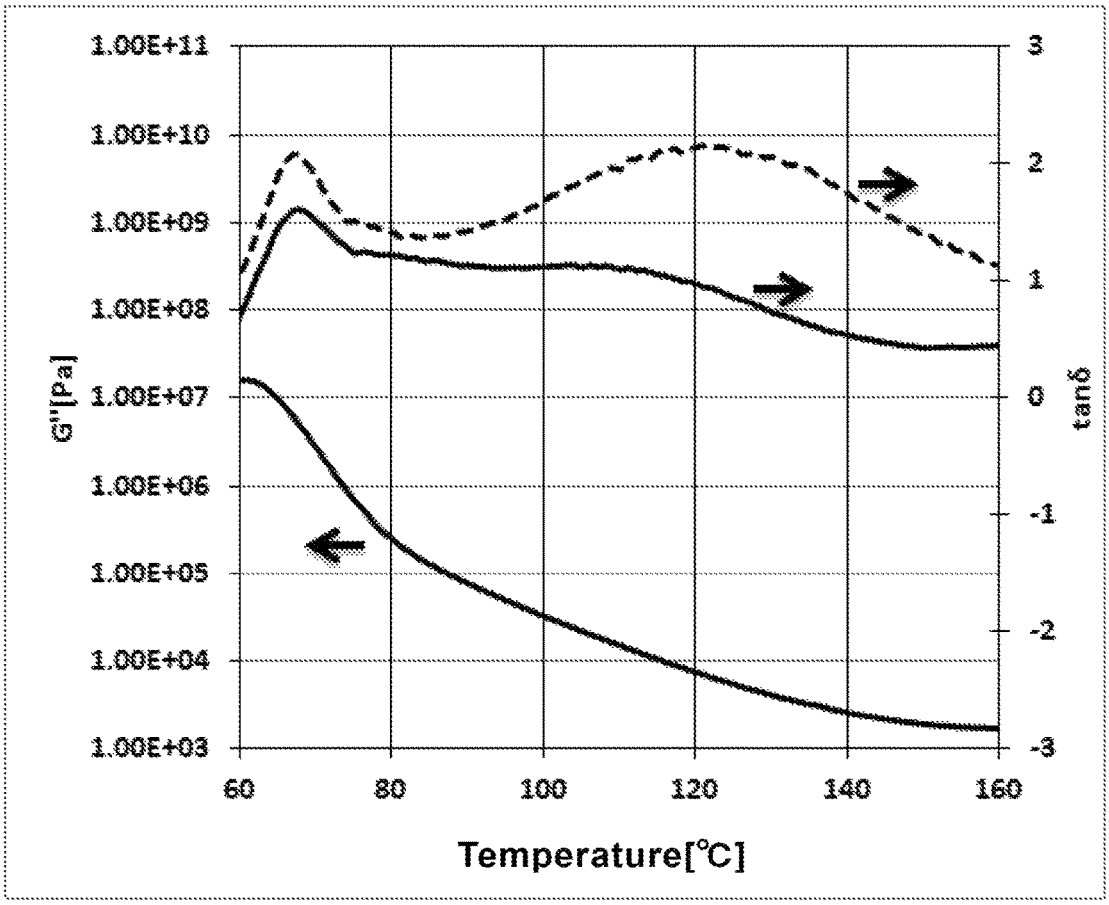
FIG. 1 is a graph that shows the viscoelasticity of toner 1.

Unless specifically indicated otherwise, text such as "at least XX and not more than YY" and "XX to YY" that shows numerical value ranges refers in the present invention to numerical value ranges that include the lower limit and upper limit that are the end points.

The toner of the present invention is more particularly described in the following.

As a result of intensive investigations in order to solve the problems with the prior art as described above, the present inventors discovered that these problems could be solved by controlling the degree of plasticization by the crystalline material of the binder resin and by controlling the viscoelastic properties of the toner.

That is, the toner of the present invention is a toner comprising a toner particle containing a binder resin and a crystalline material, wherein when "a" is an endothermic quantity deriving from the crystalline material in a differential scanning calorimetric measurement of the toner and "b" is an endothermic quantity deriving from the crystalline material in a differential scanning calorimetric measurement of the toner that has been held for 10 hours in an environment with a temperature of 55° C. and a humidity of 8% RH, the "a" and "b" satisfy a relationship $a/b \geq 0.85$; in a dynamic viscoelastic measurement of a non-melt-molded pellet of the toner, the toner has a temperature range A for which $G'' \leq 1 \times 10^5$ Pa and tan $\delta < 1$ are satisfied; and in a dynamic viscoelastic measurement of a melt-molded pellet of the toner, the toner has a temperature range B for which tan $\delta > 1$ is satisfied within the temperature range A: the dynamic viscoelasticity is measured using a rotational parallel plate rheometer in temperature sweep mode in a temperature range of 50° C. to 160° C. at a temperature ramp rate of 2.0° C./minute and an oscillation frequency of 1.0 Hz (6.28 rad/s).

The relationship (a/b) between the endothermic quantities may also be represented by the degree of crystallinity of the crystalline material as determined by differential scanning calorimetric measurement of the toner. In this case, the degree of crystallinity of the crystalline material as determined by differential scanning calorimetric measurement of the toner is at least 85%.

The present inventors hold as follows with regard to the mechanism by which the toner of the present invention can exhibit the aforementioned effects.

Image dropout is a fixing defect in which the image is missing in the form of small dots of about 1 $mm^2$. It is thought that the starting point for this is when fixing proceeds with a part of the image swollen into a dome shape due to external forces during fixing, e.g., attachment to the fixing roller or water vapor generated from the fixing media.

Image dropout tends to be produced more readily at faster fixation speeds and at larger toner laid-on amounts. It is thought that the results of the dynamic viscoelastic measurement of the non-melt-molded pellet represent the viscoelastic behavior of the surface of the toner and that the results of the dynamic viscoelastic measurement of the melt-molded pellet represent the viscoelastic behavior of the interior of the toner.

That is, when the toner has a temperature range A, for which $G'' \leq 1\times10^5$ Pa and tan $\delta<1$ are satisfied, in a dynamic viscoelastic measurement of a non-melt-molded pellet of the toner, the surface of the softened toner having $G'' \leq 1\times10^5$ Pa is controlled by elastic behavior during traverse through the fixing nip.

When, in a dynamic viscoelastic measurement of a melt-molded pellet of the toner, the toner has a temperature range B within the temperature range A and for which tan $\delta>1$ is satisfied, this indicates that during traverse through the fixing nip the surface of the toner is controlled by elastic behavior while the interior of the toner is controlled by viscous behavior, and that after traverse through the fixing nip a condition is assumed in which the toner as a whole is controlled by viscous behavior and is readily deformed by residual heat.

It is thought that, because the toner of the present invention has the aforementioned temperature ranges A and B, during fixing the toner itself undergoes deformation to provide a smooth, flat fixed image, while at the same time the excessive deformation of the toner surface and scission (i.e., a portion of the softened toner is broken off and a division then occurs to the paper side and the fixing roller side) caused by the aforementioned external forces are suppressed and the suppression of image dropout and an increase in gloss can then co-exist.

The aforementioned [a/b], on the other hand, refers to the degree of plasticization by the crystalline material of the binder resin. A larger [a/b] indicates a smaller degree of plasticization, and the effects due to the occurrence of the temperature ranges A and B are exhibited when [a/b] is at least 0.85.

When, on the other hand, it is less than 0.85, image dropout may still be produced even when the temperature ranges A and B are present. The cause of this is thought to probably be that a portion of the toner surface is plasticized and local deformation and scission then occur.

[a/b] preferably exceeds 0.95 because the generation of image dropout is then substantially suppressed. The upper limit for [a/b] is 1.00.

The aforementioned degree of crystallinity also likewise denotes the degree of plasticization by the crystalline material for the binder resin. A larger degree of crystallinity indicates a smaller degree of plasticization, and the effects due to the occurrence of the temperature ranges A and B are exhibited when the degree of crystallinity is at least 85%.

When, on the other hand, it is less than 85%, image dropout may still be produced even when the temperature ranges A and B are present. The cause of this is thought to probably be that a portion of the toner surface is plasticized and local deformation and scission then occur.

The degree of crystallinity is preferably at least 95% because the generation of image dropout is then substantially suppressed. The upper limit for the degree of crystallinity is 100%.

A portion of the crystalline material ends up plasticizing the binder resin when toner particle production proceeds through a heating step and/or a step that uses a solvent. In such cases, [a/b] and the degree of crystallinity can be controlled into the indicated ranges by carrying out, for example, an annealing treatment.

The toner of the present invention preferably also has, in the dynamic viscoelastic measurement of the non-melt-molded pellet of the toner, a temperature range C for which $G'' \leq 1\times10^5$ Pa and tan $\delta>1$ are satisfied, at temperatures that are lower than the highest temperature in the temperature range A.

The presence of this temperature range C means that, during fixing and in the temperature range prior to the impingement of the aforementioned external forces, both the interior and the surface of the toner are controlled by viscous behavior and the toner is then more easily deformed. A fixed image having an even higher gloss is obtained by the presence of this temperature range C.

In the temperature range C, the strength of the gloss is correlated with the area A of a region bounded by a straight line for tan $\delta=1$ and a loss tangent curve obtained in the dynamic viscoelastic measurement of the non-melt-molded pellet of the toner, and this area A is preferably at least 3.00 and more preferably at least 5.00. A fixed image with a very high gloss is then obtained. The area A is also preferably not more than 30.00.

The area A can be controlled into the indicated range through the molecular weight distribution of the binder resin, the viscoelasticity of the binder resin, and the compatibility between the binder resin and the crystalline material.

The uniformity and the viscoelastic characteristics of the interior and surface of the toner particle are controlled in the toner of the present invention based on the mechanism given above.

This control method can be carried out, for example, as follows, but there is no limitation to the following.

Using a toner particle having an organosilicon polymer-containing surface layer for the toner particle, for example, the content of the organosilicon polymer forming the surface layer can be adjusted and the uniformity of the organosilicon polymer can be adjusted.

In addition, for example, the viscoelasticity of the toner particle interior can be adjusted and the degree of plasticization by the crystalline material for the binder resin in the toner particle can be adjusted. A more specific description follows.

A binder resin that will provide the aforementioned temperature range B may first be prepared.

Specifically, for example, the molecular weight distribution and glass transition temperature of the binder resin can be controlled so as to provide tan $\delta>1$ and $G'' \leq 1\times10^5$ Pa.

For example, for radical-polymerized resins, the molecular weight distribution of the binder resin can be controlled through the amount of initiator, the reaction temperature, and the amount of crosslinking agent, while for condensation polymers the molecular weight distribution of the binder resin can be controlled through the monomer charge ratio, the reaction temperature, and the reaction time.

A suitable monomer selection may be made, on the other hand, with regard to the glass transition temperature of the binder resin.

The preparation of the binder resin can be carried out as appropriate by the individual skilled in the art.

An organosilicon polymer-containing surface layer may then be formed on the toner particle surface so as to generate the temperature range A. In this case, through the embedding and diffusion of the organosilicon polymer in the surface of the melted binder resin, only the surface layer of the toner particle exhibits a viscoelasticity providing tan $\delta<1$ through the filler effect.

Here, the content of the organosilicon polymer forming the surface layer and the uniformity of the organosilicon polymer in the surface layer are preferably controlled.

The filler effect is further enhanced and the generation of a viscoelasticity providing tan $\delta<1$ is facilitated by adjusting the content of the organosilicon polymer. In addition, this facilitates obtaining the temperature range B for which tan $\delta>1$ is satisfied within the temperature range A.

Similarly, the filler effect is further enhanced and obtaining the temperature range A is facilitated by adjusting the uniformity of the organosilicon polymer. Here, this "uniformity" denotes a state in which there is no skew or bias in the position of occurrence of the organosilicon polymer at the toner particle surface.

The content of the organosilicon polymer, per 100 mass parts of the toner particle, is preferably at least 0.5 mass parts and not more than 5.0 mass parts and is more preferably at least 1.0 mass parts and not more than 4.0 mass parts.

In the method in which a surface layer containing an organosilicon polymer, see below, is formed in an aqueous medium, the uniformity of the organosilicon polymer can be controlled through changes in the content of the organosilicon polymer and the pH and temperature of the aqueous medium.

With regard to other approaches for obtaining the temperature range A, a first example is to facilitate the embedding of the organosilicon polymer in the binder resin surface. Specifically, in the method in which a surface layer containing an organosilicon polymer, see below, is formed in an aqueous medium, the embedding of the organosilicon polymer in the binder resin surface can be facilitated by precipitating the organosilicon polymer on the toner particle surface using, for example, the sol-gel method, and thereafter performing a heat (annealing) treatment.

The temperature condition for this heat (annealing) treatment is preferably at least the glass transition temperature (Tg) of the binder resin and not more than the glass transition temperature (Tg)+15° C., more preferably at least Tg and not more than Tg+10° C., and even more preferably at least Tg and not more than Tg+5° C.

The time is preferably at least 1 hour and not more than 10 hours, more preferably at least 1 hour and not more than 5 hours, and even more preferably at least 3 hours and not more than 5 hours.

Hydrolysis and dehydration condensation occur upon heating in a state in which the organosilicon polymer is present at the interface between the aqueous medium and the binder resin, and, due to the enhanced affinity for the binder resin, the organosilicon polymer is then readily embedded in the binder resin surface.

Controlling the viscoelasticity of the binder resin is an example of another approach for obtaining the temperature range A. By controlling this viscoelasticity, diffusion of the organosilicon polymer embedded in the binder resin when the binder resin was melted can be inhibited and as a result the filler effect due to the organosilicon polymer can be further improved. In order to control the viscoelasticity of the binder resin in the direction of inhibiting the diffusion of the organosilicon polymer, for example, the molecular weight of the binder resin can be increased through the use of a crosslinking agent and/or by reducing the amount of the initiator.

Specifically, the weight-average molecular weight (Mw) of the binder resin is preferably at least 10,000 and not more than 500,000 and more preferably at least 50,000 and not more than 200,000.

Furthermore, in order to generate the temperature range C, preferably the viscoelasticity of the binder resin is controlled in the direction of inhibiting the embedding of the organosilicon polymer. By inhibiting the embedding of the organosilicon polymer, the development of the filler effect can be delayed in the softening process at $G''\leq 1\times 10^5$ Pa and the temperature range C is then readily obtained.

Similarly, control of the viscoelasticity of the binder resin can be used to adjust the area A in the temperature range C for the region bounded by the straight line for tan $\delta=1$ and the loss tangent curve obtained in the dynamic viscoelastic measurement of the non-melt-molded pellet of the toner. For example, this area A can be effectively enlarged by the addition to the binder resin of a block polymer in which an amorphous vinyl polymer segment is bonded to a crystalline polyester segment.

Approaches for controlling [a/b] and the aforementioned degree of crystallinity into the ranges indicated above can be exemplified by selecting the binder resin and crystalline material so as to provide a low compatibility between the binder resin and the crystalline material and raising the degree of crystallinity of the crystalline material in the toner particle.

In addition to the release agent described below, the crystalline material in the present invention can be exemplified by crystalline low molecular weight plasticizers (for example, terephthalate diesters) and crystalline resins as typified by crystalline polyesters (for example, the condensates of linear aliphatic diols and linear aliphatic dicarboxylic acids, hybrid resins provided by bonding such a condensate with, for example, polystyrene).

Among the preceding, the crystalline material preferably contains a crystalline polyester resin from the standpoint of the controllability of [a/b] and the controllability of the degree of crystallinity.

An advantageous example of this crystalline polyester resin is the condensation polymerization resin of an alcohol component that contains at least one compound selected from the group consisting of aliphatic diols having at least 2 and not more than 22 carbons (preferably at least 6 and not more than 12 carbons) and their derivatives, with a carboxylic acid component that contains at least one compound selected from the group consisting of aliphatic dicarboxylic acids having at least 2 and not more than 22 carbons (preferably at least 6 and not more than 12 carbons) and their derivatives.

The aforementioned hybrid resin can be exemplified by hybrid resins provided by bonding a crystalline polyester resin to a vinyl resin or a vinyl copolymer.

The content of the crystalline polyester resin, per 100 mass parts of the binder resin, is preferably at least 0.5 mass parts and not more than 15.0 mass parts and more preferably at least 2.0 mass parts and not more than 10.0 mass parts.

Viewed from the standpoint of the controllability of [a/b] and the controllability of the degree of crystallinity, the release agent is preferably a release agent with a high phase separability versus the binder resin or is preferably a release agent with a higher crystallization temperature. The degree of crystallinity of the release agent is prone to decline when toner particle production proceeds through a heating step or uses a solvent. However, the degree of crystallinity can be efficiently improved through the selection of the release agent and through the execution of an annealing treatment, infra.

An example of a method for increasing the degree of crystallinity of the crystalline material is an annealing treatment carried out by heating the crystalline material. The degree of crystallinity can be efficiently improved by modifying the heating temperature and time.

The individual components constituting the toner and the toner production method will now be described.

<Binder Resin>

The toner particle contains a binder resin, and the content of this binder resin is preferably at least 50 mass % with reference to the total amount of resin component in the toner particle.

There are no particular limitations on the binder resin, and it can be exemplified by styrene-acrylic resins, epoxy resins, polyester resins, polyurethane resins, polyamide resins, cellulose resins, polyether resins, mixed resins of the preceding, and composite resins of the preceding. Styrene-acrylic resins and polyester resins are preferred for their low cost, ease of acquisition, and excellent low-temperature fixability. Styrene-acrylic resins are more preferred because they also have an excellent durability in their developing performance.

The polyester resin is obtained by synthesis using a heretofore known method, for example, transesterification or polycondensation, using a combination of suitable selections from polybasic carboxylic acids, polyols, hydroxycarboxylic acids, and so forth.

Polybasic carboxylic acids are compounds that contain two or more carboxy groups in each molecule. Among these, the use is preferred of a dicarboxylic acid, which is a compound that has two carboxy groups in each molecule.

Examples here are oxalic acid, succinic acid, glutaric acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, hexahydroterephthalic acid, malonic acid, pimelic acid, suberic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediacetic acid, o-phenylenediacetic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid.

Polybasic carboxylic acids other than the above-mentioned dicarboxylic acids can be exemplified by trimellitic acid, trimesic acid, pyromellitic acid, naphthalenetricarboxylic acid, naphthalenetetracarboxylic acid, pyrenetricarboxylic acid, pyrenetetracarboxylic acid, itaconic acid, glutaconic acid, n-dodecylsuccinic acid, n-dodecenylsuccinic acid, isododecylsuccinic acid, isododecenylsuccinic acid, n-octylsuccinic acid, and n-octenylsuccinic acid. A single one of these may be used by itself or two or more may be used in combination.

Polyols are compounds that contain two or more hydroxyl groups in each molecule. Among these, the use of diols, which are compounds that contain two hydroxyl groups in each molecule, is preferred.

Specific examples are ethylene glycol, diethylene glycol, triethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, diethylene glycol, triethylene glycol, dipropylene glycol, polyethylene glycol, polypropylene glycol, polytetramethylene ether glycol, 1,4-cyclohexanediol, 1,4-cyclohexanedimethanol, 1,4-butenediol, neopentyl glycol, polytetramethylene glycol, hydrogenated bisphenol A, bisphenol A, bisphenol F, bisphenol A, and alkylene oxide (e.g., ethylene oxide, propylene oxide, butylene oxide) adducts on these bisphenols. Alkylene glycols having 2 to 12 carbons and alkylene oxide adducts on bisphenols are preferred among the preceding, while alkylene oxide adducts on bisphenols and their combinations with alkylene glycols having 2 to 12 carbons are particularly preferred.

Trihydric and higher hydric alcohols can be exemplified by glycerol, trimethylolethane, trimethylolpropane, pentaerythritol, hexamethylolmelamine, hexaethylolmelamine, tetramethylolbenzoguanamine, tetraethylolbenzoguanamine, sorbitol, trisphenol PA, phenol novolacs, cresol novolacs, and alkylene oxide adducts on these trihydric and higher hydric polyphenols. A single one of these may be used by itself or two or more may be used in combination.

The styrene-acrylic resin can be exemplified by homopolymers of the polymerizable monomers given below, copolymers obtained from combinations of two or more of these, and mixtures of the preceding:

styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylic derivatives such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxyethyl acrylate, acrylonitrile, 2-hydroxyethyl acrylate, and acrylic acid;

methacrylic derivatives such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, cyclohexyl methacrylate, benzyl methacrylate, dimethyl phosphate ethyl methacrylate, diethyl phosphate ethyl methacrylate, dibutyl phosphate ethyl methacrylate and 2-benzoyloxyethyl methacrylate, methacrylonitrile, 2-hydroxyethyl methacrylate, and methacrylic acid;

vinyl ether derivatives such as vinyl methyl ether and vinyl isobutyl ether;

vinyl ketone derivatives such as vinyl methyl ketone, vinyl ethyl ketone, and vinyl isopropenyl ketone; and polyolefins such as ethylene, propylene, and butadiene.

A multifunctional polymerizable monomer may as necessary be used for the styrene-acrylic resin. This multifunctional polymerizable monomer can be exemplified by diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, diethylene glycol dimethacrylate, triethylene glycol dimechacrylate, tetraethylene glycol dimethacrylate, polyethylene glycol dimethacrylate, 1,6-hexanediol dimethacrylate, neopentyl glycol dimethacrylate, tripropylene glycol dimethacrylate, polypropylene glycol dimethacrylate, 2,2'-bis(4-(methacryloxydiethoxy)phenyl)propane, trimethylolpropane trimethacrylate, tetramethylolmethane tetramethacrylate, divinylbenzene, divinylnaphthalene, and divinyl ether.

A known chain transfer agent and polymerization inhibitor may also be added in order to control the degree of polymerization.

Polymerization initiators for obtaining the styrene-acrylic resin can be exemplified by organoperoxide-type initiators and azo-type initiators.

The organoperoxide-type initiators can be exemplified by benzoyl peroxide, lauroyl peroxide, di-α-cumyl peroxide, 2,5-dimethyl-2,5-bis(benzoylperoxy)hexane, bis(4-t-butylcyclohexyl) peroxydicarbonate, 1,1-bis(t-butylperoxy)cyclododecane, t-butyl peroxymaleate, bis(t-butylperoxy) isophthalate, methyl ethyl ketone peroxide, tert-butyl peroxy-2-ethylhexanoate, diisopropyl peroxycarbonate, cumene hydroperoxide, 2,4-dichlorobenzoyl peroxide, and tert-butyl peroxypivalate.

The azo-type initiators can be exemplified by 2,2'-azobis (2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobismethylbutyronitrile, and 2,2'-azobis(methyl isobutyrate).

A redox initiator composed of a combination of an oxidizing substance and a reducing substance may also be used as the polymerization initiator. The oxidizing substance can be exemplified by hydrogen peroxide, inorganic peroxides of persulfate salts (sodium salt, potassium salt, ammonium salt), and oxidizing metal salts of tetravalent cerium salts. The reducing substance can be exemplified by reducing metal salts (divalent iron salts, monovalent copper salts, and trivalent chromium salts); ammonia; lower amines (amines having approximately at least 1 and not more than 6 carbons, such as methylamine and ethylamine); amino compounds such as hydroxylamine; reducing sulfur compounds such as sodium thiosulfate, sodium hydrosulfite, sodium bisulfite, sodium sulfite, and sodium formaldehyde sulfoxylate; lower alcohols (at least 1 and not more than 6 carbons); ascorbic acid and its salts; and lower aldehydes (at least 1 and not more than 6 carbons).

The polymerization initiator is selected considering the 10-hour half-life temperature, and a single one or a mixture may be used. The amount of addition of the polymerization initiator will vary as a function of the desired degree of polymerization, but generally at least 0.5 mass parts and not more than 20.0 mass parts is added per 100.0 mass parts of the polymerizable monomer.

<Release Agent>

A known wax can be used as the release agent in the toner of the present invention.

Specific examples are petroleum waxes as represented by paraffin waxes, microcrystalline waxes, and petrolatum, and derivatives thereof; montan wax and derivatives thereof; hydrocarbon waxes as provided by the Fischer-Tropsch method, and derivatives thereof; polyolefin waxes as represented by polyethylene, and derivatives thereof; and natural waxes as represented by carnauba wax and candelilla wax, and derivatives thereof. The derivatives include oxides and graft modifications and block copolymers with vinyl monomers. Other examples are alcohols such as higher aliphatic alcohols; fatty acids such as stearic acid and palmitic acid, and their amides, esters, and ketones; hardened castor oil and derivatives thereof; and plant waxes and animal waxes. A single one of these or combinations can be used.

Among the preceding, the use of polyolefins, hydrocarbon waxes produced by the Fischer-Tropsch method, and petroleum waxes is preferred because they provide an improved developing performance and an improved transferability. An oxidation inhibitor may be added to these waxes within a range that does not influence the charging performance of the toner.

Viewed from the standpoint of the phase separation behavior with respect to the binder resin or from the standpoint of the crystallization temperature, advantageous examples are the esters of higher fatty acids, e.g., behenyl behenate and dibehenyl sebacate.

The content of these waxes is preferably at least 1.0 mass parts and not more than 30.0 mass parts per 100.0 mass parts of the binder resin.

The melting point of the wax is preferably at least 30° C. and not more than 120° C. and more preferably at least 60° C. and not more than 100° C.

When a wax exhibiting such a thermal characteristic is used, this results in an efficient expression of the release effect and secures a wider fixation region.

<Colorant>

The toner particle in the present invention may contain a colorant. A known pigment or dye can be used as this colorant. Pigments are preferred for this colorant for their excellent weather resistance. The cyan colorant can be exemplified by copper phthalocyanine compounds and their derivatives, anthraquinone compounds, and basic dye lake compounds.

Specific examples are C. I. Pigment Blue 1, 7, 15, 15:1, 15:2, 15:3, 15:4, 60, 62, and 66.

The magenta colorant can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are C. I. Pigment Red 2, 3, 5, 6, 7, 19, 23, 48:2, 48:3, 48:4, 57:1, 81:1, 122, 144, 146, 150, 166, 169, 177, 184, 185, 202, 206, 220, 221, and 254 and C. I. Pigment Violet 19.

The yellow colorant can be exemplified by condensed azo compounds, isoindolinone compounds, anthraquinone compounds, azo-metal complexes, methine compounds, and allylamide compounds.

Specific examples are C. I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191, and 194.

The black colorant can be exemplified by carbon black and by black colorants provided by color mixing to give black using the aforementioned yellow colorants, magenta colorants, and cyan colorants.

A single one of these colorants may be used by itself or a mixture of these colorants may be used, and they may be used in the form of their solid solutions.

The colorant is preferably used at at least 1.0 mass parts and not more than 20.0 mass parts per 100.0 mass parts of the binder resin.

<Charge Control Agent and Charge Control Resin>

The toner particle in the present invention may contain a charge control agent or a charge control resin.

A known charge control agent can be used, and in particular a charge control agent is preferred that provides a fast triboelectric charging speed and that supports the stable maintenance of a certain or constant amount of triboelectric charge. Moreover, when the toner particle is produced by a suspension polymerization method, a charge control agent is particularly preferred that exhibits little inhibition of the polymerization and that is substantially free of material soluble in aqueous media.

The charge control agents include those that control the toner to negative charging and those that control the toner to positive charging.

Charge control agents that control the toner to negative charging can be exemplified by monoazo-metal compounds; acetylacetone-metal compounds; metal compounds of aromatic oxycarboxylic acids, aromatic dicarboxylic acids, oxycarboxylic acids, and dicarboxylic acids; aromatic oxycarboxylic acids and aromatic mono- and polycarboxylic acids and their metal salts, anhydrides, and esters; phenol derivatives such as bisphenol; urea derivatives; metal-containing salicylic acid compounds; metal-containing naphthoic acid compounds; boron compounds; quaternary ammonium salts; calixarene; and charge control resins.

Charge control agents that control the toner to positive charging can be exemplified by the following:

guanidine compounds; imidazole compounds; quaternary ammonium salts such as tributylbenzylammonium 1-hydroxy-4-naphthosulfonate and tetrabutylammonium tetrafluoroborate, and onium salts, such as phosphonium salts, that are analogues of the preceding, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanide, and ferrocyanide); metal salts of higher fatty acids; and charge control resins.

Among these charge control agents, metal-containing salicylic acid compounds are preferred and those in which the metal is aluminum or zirconium are preferred in particular.

The charge control resin can be exemplified by polymers and copolymers that contain the sulfonic acid group, sulfonate salt group, or sulfonate ester group. Preferred in particular for polymers that contain the sulfonic acid group, sulfonate salt group, or sulfonate ester group are polymers that contain at least 2 mass %, as the copolymerization ratio, of a sulfonic acid group-containing acrylamide-type monomer or a sulfonic acid group-containing methacrylamide-type monomer, while polymers containing at least 5 mass % of same are more preferred.

The charge control resin preferably has a glass transition temperature (Tg) of at least 35° C. and not more than 90° C., a peak molecular weight (Mp) of at least 10,000 and not more than 30,000, and a weight-average molecular weight (Mw) of at least 25,000 and not more than 50,000. When such is used, preferred triboelectric charging characteristics can be imparted without influencing the thermal characteristics required of the toner particle. Moreover, because the charge control resin contains the sulfonic acid group, for example, the dispersibility of the charge control resin itself and the dispersibility of, e.g., the colorant, in the polymerizable monomer composition are improved and the tinting strength, transparency, and triboelectric charging characteristics can then be further improved.

A single one of these charge control agents or charge control resins may be added by itself or a combination of two or more may be added.

The amount of addition of the charge control agent or charge control resin, per 100.0 mass parts of the binder resin, is preferably at least 0.01 mass parts and not more than 20.0 mass parts and is more preferably at least 0.5 mass parts and not more than 10.0 mass parts.

<Organosilicon Polymer>

The toner particle in the present invention preferably has a surface layer that contains an organosilicon polymer. This organosilicon polymer can be exemplified by polymers of organosilicon compounds having the structure represented by the following formula (Z).

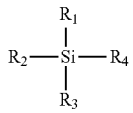

(Z)

(In formula (Z), $R_1$ represents a hydrocarbon group having at least 1 and not more than 6 carbons or an aryl group, and $R_2$, $R_3$, and $R_4$ each independently represent a halogen atom, hydroxy group, acetoxy group, or alkoxy group.)

Specific examples of this formula (Z) are as follows:

methyltrimethoxysilane, methyltriethoxysilane, methyltrichlorosilane, ethyltrimethoxysilane, ethyltriethoxysilane, ethyltrichlorosilane, ethyltriacetoxysilane, propyltrimethoxysilane, propyltriethoxysilane, propyltrichlorosilane, butyltrimethoxysilane, butyltriethoxysilane, butyltrichlorosilane, butylmethoxydichlorosilane, butylethoxydichlorosilane, hexyltrimethoxysilane, hexyltriethoxysilane, phenyltrimethoxysilane, and phenyltriethoxysilane. A single one of these organosilicon compounds may be used by itself or two or more may be used in combination.

The production method known as the sol-gel method is an example of a typical method for producing the organosilicon polymer.

It is known that the bonding regime of the siloxane bond that is produced generally varies in the sol-gel method as a function of the acidity of the reaction medium. Specifically, when the medium is acidic, the hydrogen ion undergoes electrophilic addition to the oxygen in one reactive group (for example, the alkoxy group; —OR group). The oxygen atom in a water molecule then coordinates to the silicon atom and a hydrosilyl group is provided by a substitution reaction. When sufficient water is present, the substitution reaction to the hydroxyl group is slow when the $H^+$ content in the medium is low since one $H^+$ attacks one oxygen in the reactive group (for example, the alkoxy group; —OR group). Thus, the condensation polymerization reaction occurs before all the reactive groups attached to the silane undergo hydrolysis and a one-dimensional linear polymer and/or a two-dimensional polymer is then relatively readily produced.

When, on the other hand, the medium is alkaline, the hydroxide ion adds to the silicon and the reaction proceeds through a pentacoordinate intermediate. As a consequence, all of the reactive groups (for example, the alkoxy group; —OR group) are easily eliminated and readily converted into the silanol group. In particular, when a silicon compound is used that has three or more reactive groups in the same silane, hydrolysis and condensation polymerization are produced three dimensionally and an organosilicon polymer is formed that has numerous three-dimensional crosslinking bonds. The reaction is also completed in a short period of time.

In addition, since the sol-gel method starts from a solution and material is formed by the gelation of this solution, various fine structures and shapes can then be produced. In particular, when the toner particle is produced in an aqueous medium, the presence at the surface of the toner particle is readily induced by the hydrophilicity generated by hydrophilic groups such as the silanol group in the organosilicon compound.

Accordingly, the sol-gel reaction for forming the organosilicon polymer is preferably carried out under conditions in which the reaction medium is alkaline, and when production is carried out in an aqueous medium, specifically the reaction is preferably run at a pH of at least 8.0 at a reaction temperature of at least 90° C. for a reaction time of at least 5 hours. By doing this, an organosilicon polymer can be formed that has a higher strength and an excellent durability.

The organosilicon polymer preferably has a structure represented by the following formula (T3), and the proportion of the structure represented by the following formula (T3) with reference to the total number of silicon atoms in the organosilicon polymer is preferably at least 5.0%, more preferably at least 10.0%, and even more preferably at least 20.0%. This proportion is preferably not more than 90.0%.

$$R^0—SiO_{3/2} \quad (T3)$$

($R^0$ represents an alkyl group having at least 1 and not more than 6 carbons or a phenyl group.)

Doing this improves the affinity between this organosilicon polymer and the binder resin and facilitates obtaining the temperature range A.

<Toner Production Method>

A first production method is a method in which the toner particle is obtained by forming, in an aqueous medium, a particle of a polymerizable monomer composition that contains the crystalline material, polymerizable monomer that will produce the binder resin, and as necessary an organosilicon compound and other additives, and then polymerizing the polymerizable monomer present in this polymerizable monomer composition particle.

When the organosilicon compound has been added here, a surface layer containing an organosilicon polymer can be formed on the toner particle since the polymerization is carried out under conditions in which the organosilicon compound precipitates in the vicinity of the toner particle surface. In addition, when this production method is used, the organosilicon polymer readily precipitates uniformly.

A second production method is a method in which a toner particle core is obtained followed by the formation of a surface layer of the organosilicon polymer in an aqueous medium. The toner particle core may be produced using, for example, a melt-kneading and pulverization method, an emulsification and aggregation method, a dissolution suspension method, and so forth.

The aqueous medium here can be exemplified by the following in the present invention:

water; alcohols such as methanol, ethanol, and propanol; and their mixed media. The suspension polymerization method is the most preferred production method from the standpoint of the uniformity of the organosilicon polymer-containing surface layer that is formed on the toner particle surface. The suspension polymerization method is more particularly described in the following.

A known dispersion stabilizer that is an inorganic compound or a known dispersion stabilizer that is an organic compound can be used as the dispersion stabilizer that is used in the preparation of the aqueous medium.

Dispersion stabilizers that are inorganic compounds can be exemplified by tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina.

Dispersion stabilizers that are organic compounds, on the other hand, can be exemplified by polyvinyl alcohol, gelatin, methyl cellulose, methylhydroxypropyl cellulose, ethyl cellulose, the sodium salt of carboxymethyl cellulose, polyacrylic acid and its salts, and starch. The use amount of these dispersion stabilizers is preferably at least 0.2 mass parts and not more than 20.0 mass parts per 100 mass parts of the polymerizable monomer.

When, among these dispersion stabilizers, a dispersion stabilizer that is an inorganic compound is used, a commercial dispersion stabilizer may be used as is, or the inorganic compound may be produced in the aqueous medium in order to obtain a dispersion stabilizer with a finer particle diameter. For example, in the case of tricalcium phosphate, it can be obtained by mixing an aqueous sodium phosphate solution with an aqueous calcium chloride solution under vigorous stirring.

An external additive may be externally added to the obtained toner particle in order to impart various properties to the toner. External additives for improving the toner flowability can be exemplified by inorganic fine particles such as silica fine particles, titanium oxide fine particles, and their composite oxide fine particles. Silica fine particles and titanium oxide fine particles are preferred among the inorganic fine particles.

The silica fine particles can be exemplified by dry silica or fumed silica as produced by the vapor-phase oxidation of silicon halide and by wet silica produced from water glass.

Dry silica, which has little silanol group at the surface or in the interior of the silica fine particle and which contains little $Na_2O$ and $SO_3^{2-}$, is preferred for the inorganic fine particles. The dry silica may also be a composite fine particle of silica and another metal oxide, as provided by the use in the production process of a silicon halide in combination with another metal halide compound such as aluminum chloride or titanium chloride.

The inorganic fine particle is preferably a hydrophobed inorganic fine particle as provided by a hydrophobic treatment of its surface with a treatment agent, because this can achieve modulation of the triboelectric charge quantity of the toner, improvements in the environmental stability of the toner, and improvements in the flowability of the toner under high temperatures and high humidities.

The treatment agent for carrying out a hydrophobic treatment of the inorganic fine particle can be exemplified by unmodified silicone varnishes, variously modified silicone varnishes, unmodified silicone oils, variously modified silicone oils, silicon compounds, silane coupling agents, other organosilicon compounds, and organotitanium compounds. Silicone oils are preferred among the preceding. A single one of these treatment agents may be used or a combination may be used.

The total amount of addition of the inorganic fine particle, per 100 mass parts of the toner particle, is preferably at least 1.00 mass parts and not more than 5.00 mass parts and is more preferably at least 1.00 mass parts and not more than 2.50 mass parts. From the standpoint of the durability of the toner, the external additive preferably has a particle diameter of not more than one-tenth of the average particle diameter of the toner particle.

In the roughness profile curve measured on the toner particle using a scanning probe microscope, the mean width (RSm) in the present invention of the roughness profile curve elements on the toner particle is preferably at least 20 nm and not more than 500 nm and more preferably at least 50 nm and not more than 200 nm.

A filler effect is readily obtained by having RSm satisfy the indicated range.

RSm can be controlled into the indicated range by adjusting the particle diameter and content of, e.g., the organosilicon polymer and the inorganic fine particles that exhibit the filler effect.

The ratio (σRSm/RSm) of the standard deviation σRSm on RSm, to RSm is preferably not more than 0.80, and more preferably not more than 0.75.

A filler effect is readily obtained by having [σRSm/RSm] satisfy the indicated range. In addition, in methods in which a surface layer containing the aforementioned organosilicon polymer is formed in an aqueous medium, [σRSm/RSm] can be controlled into the indicated range by changing the content of the organosilicon polymer and the pH and temperature of the aqueous medium.

The methods for measuring the various properties pertaining to the present invention are described below.

<Measurement of the Dynamic Viscoelasticity of the Toner>

An "ARES" (TA Instruments) rotational parallel plate rheometer is used as the measurement instrument. The following is used as the measurement sample: a sample provided by compression molding the toner into a circular disk with a diameter of 7.9 mm and a thickness of 2.0±0.3 mm using a tablet molder in a 25° C. environment.

(i) Dynamic Viscoelastic Measurement on a Non-melt-molded Pellet of the Toner

This sample is placed in the parallel plates; the temperature is raised from room temperature (25° C.) to the starting temperature (50° C.) for the viscoelasticity measurements; and measurement under the conditions indicated below is started.

(ii) Dynamic Viscoelastic Measurement on a Melt-molded Pellet of the Toner

This sample is placed in the parallel plates and the temperature is raised from room temperature (25° C.) to 120° C. in 15 minutes. After the temperature ramp up and while holding at 120° C. for 1 minute, the parallel plates are displaced up-and-down in 5 back-and-forth excursions at an amplitude of 1 cm and the shape of the sample is trimmed; this is followed by cooling to the start temperature for the viscoelasticity measurements (50° C.); and measurement under the following conditions is started.

The measurement conditions are as follows.

(1) The sample is set so the initial normal force is 0.

(2) Parallel plates with a diameter of 7.9 mm are used.

(3) The frequency (Frequency) is made 1.0 Hz.

(4) The initial value of applied strain (Strain) is set to 0.1%.

(5) Measurement is carried out at a ramp rate (Ramp Rate) of 2.0° C./minute between 50° C. to 160° C. at a sampling frequency of 1 time/° C. The measurement is performed at the following setting conditions for automatic adjustment mode. The measurement is run in automatic strain adjustment mode (Auto Strain).

(6) The maximum strain (Max Applied Strain) is set to 20.0%.

(7) The maximum torque (Max Allowed Torque) is set to 200.0 g·cm and the minimum torque (Min Allowed Torque) is set to 0.2 g·cm.

(8) The strain adjustment (Strain Adjustment) is set to 20.0% of Current Strain. The automatic tension adjustment mode (Auto Tension) is used in the measurement.

(9) The automatic tension direction (Auto Tension Direction) is set to compression (Compression).

(10) The initial static force (Initial Static Force) is set to 10.0 g and the automatic tension sensitivity (Auto Tension Sensitivity) is set to 40.0 g.

(11) For the automatic tension (Auto Tension) operating condition, the sample modulus (Sample Modulus) is at least $1.0\times10^3$ (Pa). Using quadrature by parts as follows, the area A is determined from the viscoelasticity measurement results obtained as described above.

Using temperature (° C.) for the horizontal axis and tan δ for the vertical axis, tan δ is plotted for the dynamic viscoelastic measurement of the non-melt-molded pellet of the toner. Calculation is carried out in the temperature range C for the region bounded by this curve and the straight line for tan δ=1. Specifically, the value of the area A was taken to be the sum total of the tan δ value×1 for each plot.

<Measurement of the Endothermic Quantity Deriving from the Crystalline Material of the Toner>

The endothermic quantity a deriving from the crystalline material of the toner is measured first.

The endothermic quantity b deriving from the crystalline material of the toner that has been held for 10 hours at a temperature of 55° C. and a humidity of 8% RH is then measured.

[a/b] is calculated from the obtained a and b.

Measurement of these endothermic quantities is performed under the following conditions using a DSC Q2000 (TA Instruments).

sample amount: 5.0 mg
sample pan: aluminum
ramp rate: 10.0° C./minute
measurement start temperature: 20.0° C.
measurement end temperature: 180.0° C.

The melting points of indium and zinc are used for temperature correction in the instrument detection section, and the heat of fusion for indium is used for correction of the amount of heat.

<Determination of the Degree of Crystallinity of the Crystalline Material in the Toner>

Using a DSC Q2000 (TA Instruments), 5.0 mg of the toner is weighed into an aluminum pan; a first heating is carried out from 0° C. to 150° C. at a ramp rate of 10.0° C./minute; and holding is carried out at 150° C. for 5 minutes. Cooling is then carried out to 55° C. at a ramp down rate of 10.0° C./minute and holding is carried out at 55° C. for 10 hours. Cooling is then carried out to 0° C. at a ramp down rate of 10.0° C./minute and holding is carried out at 0° C. for 5 minutes. A second heating is then performed from 0° C. to 150° C. at a ramp rate of 10.0° C./minute. The degree of crystallinity of the crystalline material in the toner is calculated as the percentage (%) for the endothermic quantity in the first heating process with respect to the endothermic quantity in the second heating process.

The melting points of indium and zinc are used for temperature correction in the instrument detection section, and the heat of fusion for indium is used for correction of the amount of heat.

<Measurement of the Molecular Weight>

The weight-average molecular weight (Mw) of, e.g., the binder resin, is measured as follows by gel permeation chromatography (GPC).

First, the sample is dissolved in tetrahydrofuran (THF) at room temperature. The obtained solution is filtered with a "Sample Pretreatment Cartridge" (Tosoh Corporation) solvent-resistant membrane filter having a pore diameter of 0.2 μm to obtain a sample solution. The sample solution is adjusted to a concentration of THF-soluble component of 0.8 mass %. Measurement is carried out under the following conditions using this sample solution.

instrument: "HLC-8220GPC" high-performance GPC instrument [Tosoh Corporation]

column: 2×LF-604 [Showa Denko K. K.]

eluent: THF flow rate: 0.6 mL/minute oven temperature: 40° C.

sample injection amount: 0.020 mL

A molecular weight calibration curve constructed using polystyrene resin standards (product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

<Measurement of the Glass Transition Temperature (Tg)>

The glass transition temperature (Tg) of the resins is measured using a "01000" (TA Instruments) differential scanning calorimeter in accordance with ASTM D 3418-82.

The melting points of indium and zinc are used for temperature correction in the instrument detection section, and the heat of fusion of indium is used to correct the amount of heat.

Specifically, approximately 5 mg of the sample is exactly weighed out and is introduced into an aluminum pan, and, using an empty aluminum pan for reference, the measurement is run in the measurement range from 30° C. to 200° C. at a ramp rate of 1° C./minute.

The change in the specific heat in the temperature range from 40° C. to 100° C. is obtained in this heating process. The glass transition temperature (° C.) of the binder resin is taken to be the point at the intersection between the differential heat curve and the line for the midpoint for the baselines for prior to and subsequent to the appearance of the change in the specific heat during this process.

<Measurement Using a Scanning Probe Microscope of the Mean Width (RSm) of the Roughness Profile Curve Elements on the Toner Particle and the Standard Deviation (σRSm) on RSm>

The mean width (RSm) of the roughness profile curve elements on the toner particle and the standard deviation (σRSm) on RSm were measured using the following measurement instrumentation and measurement conditions scanning probe microscope: Hitachi High-Tech Science Corporation measurement unit: E-sweep measurement mode: DFM (resonance mode) shape image resolution: 256 for number of X data, 128 for number of Y data measurement area: 1 μm square Toner particles with a particle diameter equal to the weight-average particle diameter (D4) measured by the Coulter Counter procedure, see below, were selected for the toner particles submitted to the measurement. Ten different toner particles were measured.

(1) Determination of the Mean Width (RSm) of the Roughness Profile Curve Elements The mean width (RSm) of the roughness profile curve elements was determined as follows.

Figure 2:
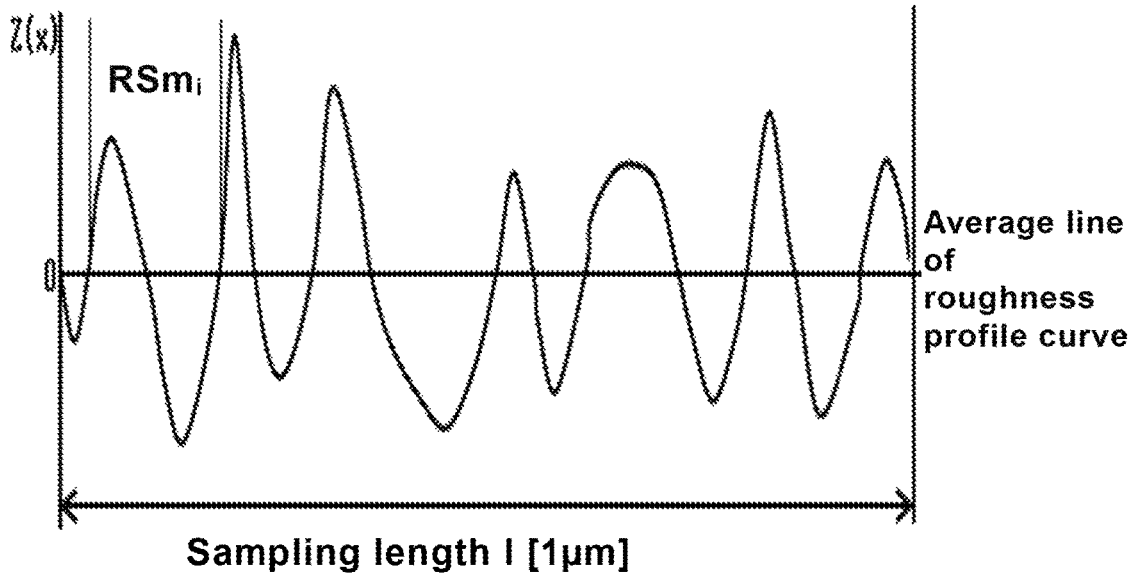
FIG. 2 shows the method for determining the mean width (RSm) and the standard deviation σRSm on RSm.

First, ten cross sections (cross section 1 to cross section 10) were randomly selected from the 1 μm square measurement area that was measured. The description that follows uses cross section 1 as an example. As shown in FIG. 2, using the average line of the roughness profile curve for reference, the width $RSm_i$ of the region produced by the peak and valley in 1 period was measured for all the peak-and-valley periods. The average width RSm' of the roughness profile curve elements in cross section 1 was then calculated using the following formula.

$$RSm' = \frac{1}{n}\sum_{i=1}^{n} RSm_i$$

n: total number of peak-and-valley periods in cross section 1

All of the RSm' values were calculated for cross sections 1 to 10 and their average value was calculated to yield the mean width (RSm) of the roughness profile curve elements for the toner particle.

(2) Calculation of the Standard Deviation (σRSm) on RSm

The standard deviation σRSm on RSm was defined as below.

Using the following formula, the standard deviation σRSm' on the RSm' for cross section 1 was calculated in the aforementioned method for calculating RSm' for cross section 1.

$$\sigma RSm' = \sqrt{\frac{\sum_{i=1}^{n} (Rsm_i - RSm')^2}{n-1}}$$

n: total number of peak-and-valley periods in cross section 1

All of the σRSm' values were calculated for cross sections 1 to 10 and their average value was calculated to yield the standard deviation (σRSm) on RSm for the toner particle.

<Measurement of the Weight-average Particle Diameter (D4) and Number-average Particle Diameter (D1) of the Toner or Toner Particle>

The weight-average particle diameter (D4) and number-average particle diameter (D1) of the toner or toner particle is determined by performing measurement in 25,000 channels for the number of effective measurement channels and analyzing the measurement data using a "Coulter Counter Multisizer 3" (registered trademark, Beckman Coulter, Inc.), a precision particle size distribution measurement instrument operating on the pore electrical resistance method and equipped with a 100 μm aperture tube, and using the accompanying dedicated software, i.e., "Beckman Coulter Multisizer 3 Version 3.51" (Beckman Coulter, Inc.), to set the measurement conditions and analyze the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to at least 2 μm and not more than 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W and equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner or toner particle is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the aqueous electrolyte solution prepared in (5), in which toner or toner particles are dispersed, is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4). When set to graph/number % with the dedicated software, the "average diameter" on the "analysis/numerical statistical value (arithmetic average)" screen is the number-average particle diameter (D1).

<Preparation of the Tetrahydrofuran (THF)-insoluble Matter in the Toner>

The tetrahydrofuran (THF)-insoluble matter in the toner was prepared as follows.

10.0 g of the toner was Weighed out and was introduced into a thimble (product name: No. 86R, Toyo Roshi Kaisha, Ltd.) and this was installed in a Soxhlet extractor. Extraction was carried out for 20 hours using 200 mL of THF as the solvent, and the filtered material in the thimble was vacuum dried for several hours at 40° C. to obtain the THF-insoluble matter in the toner for submission to NMR measurement.

<Method for Determining the Proportion of the Structure Given by Formula (T3) with Respect to the Total Number of Silicon Atoms in the Organosilicon Polymer>

The proportion of the structure given by the following formula (T3) with respect to the total number of silicon atoms in the organosilicon polymer is determined as follows.

$$R^0—SiO_{3/2} \quad (T3)$$

$^{13}$C-NMR and $^{29}$Si-NMR were used to confirm the presence/absence of the $C_{1-6}$ alkyl group or phenyl group represented by $R^0$ in formula (T3). In addition, the detailed structure of formula (T3) was confirmed by $^1$H-NMR, $^{13}$C-NMR, and $^{29}$Si-NMR. The instrumentation and measurement conditions used are given below.

($^1$H-NMR (solid) measurement conditions)

instrument: AVANCE III 500 from Bruker Corporation probe: 4 mm MAS BB/1H measurement temperature: room temperature sample spinning rate: 6 kHz sample: 150 mg of the measurement sample (THF-insoluble matter in the toner for submission to NMR measurement) is introduced into a sample tube with a diameter of 4 mm.

The presence/absence of the $C_{1-6}$ alkyl group or phenyl group represented by $R^0$ in formula (T3) was checked by this method. The structure given by formula (T3) was scored as "present" when a signal was confirmed.

($^{13}$C-NMR (solid) measurement conditions)

instrument: AVANCE III 500 from Bruker Corporation probe: 4 mm MAS BB/1H measurement temperature: room temperature sample spinning rate: 6 kHz sample: 150 mg of the measurement sample (THF-insoluble matter in the toner for submission to NMR measurement) is introduced into a sample tube with a diameter of 4 mm.

measured nucleus frequency: 125.77 MHz reference substance: glycine (external reference: 176.03 ppm)

observation width: 37.88 kHz measurement method: CP/MAS contact time: 1.75 ms repeat time: 4 s number of integrations: 2048 times LB value: 50 Hz ($^{29}$Si-NMR (solid) measurement method)

instrument: AVANCE III 500 from Bruker Corporation probe: 4 mm MAS BB/1H measurement temperature: room temperature sample spinning rate: 6 kHz sample: 150 mg of the measurement sample (THF-insoluble matter in the toner for submission to the NMR measurement) is introduced into a sample tube with a diameter of 4 mm.

measured nucleus frequency: 99.36 MHz
reference standard: DSS (external reference: 1.534 ppm)
observation width: 29.76 kHz
measurement method: DD/MAS, CP/MAS
90° pulse width: 4.00 μs, −1 dB
contact time: 1.75 ms to 10 ms
repeat time: 30 s (DD/MAS), 10 s (CP/MAS)
number of integrations: 8000 times
LB value: 50 Hz The proportion [ST3] (%) for the structure given by the preceding formula (T3) with respect to the total number of silicon atoms in the organosilicon polymer is determined as follows.

In the $^{29}$Si-NMR measurement of the tetrahydrofuran (THF)-insoluble matter in the toner, [ST3] (%) is given by the following formula where SS is the area provided by subtracting the silane monomer from the total peak area for the organosilicon polymer and S(T3) is the peak area for the structure given by formula (T3), supra.

$$ST3(\%)=\{S(T3)/SS\}\times 100$$

After the $^{29}$Si-NMR measurement on the THF-insoluble matter in the toner, peak separation is performed—by the curve fitting of the multiple silane components for the toner having different substituents and bonding groups—into the X4 structure, in which the number of silicon-bonded $O_{1/2}$ is 4.0 and given by general formula (X4) below, the X3 structure, in which the number of silicon-bonded $O_{1/2}$ is 3.0 and given by general formula (X3) below, the X2 structure, in which the number of silicon-bonded $O_{1/2}$ is 2.0 and given by general formula (X2) below, the X1 structure, in which the number of silicon-bonded $O_{1/2}$ is 1.0 and given by general formula (X1) below, and the structure given by formula (T3), and the mol % for each component is calculated from the area ratios for the individual peaks.

(X4)

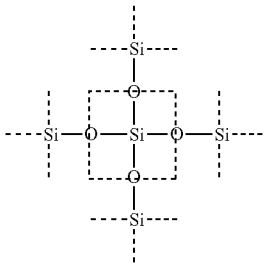

(X3)

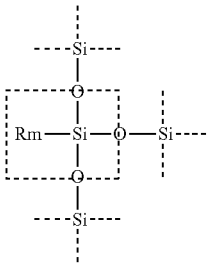

(Rm in formula (X3) is a silicon-bonded organic group, halogen atom, hydroxy group, or alkoxy group)

(X2)

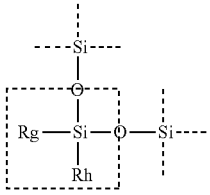

(Rg and Rh in formula (X2) are a silicon-bonded organic group, halogen atom, hydroxy group, or alkoxy group)

(X1)

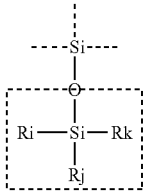

(Ri, Rj, and Rk in formula (X1) are a silicon-bonded organic group, halogen atom, hydroxy group, or alkoxy group)

The curve fitting uses the EXcalibur for Windows (registered trademark) (product name) version 4.2 (EX series) software for the JNM-EX400 from JEOL Ltd. The measurement data is read by clicking "ID Pro" from the menu icons. Curve fitting is performed by selecting the "Curve fitting function" from "Command" in the menu bar.

The area of the X1 structure, the area of the X2 structure, the area of the X3 structure, and the area of the X4 structure are determined and SX1, SX2, SX3, and SX4 are then determined using the formulas given below.

(Method for Identifying the T3, X1, X2, X3, and X4 Substructures)

The T3, X1, X2, X3, and X4 substructures can be identified by $^{1}$H-NMR, $^{13}$C-NMR, and $^{29}$Si-NMR.

After the NMR measurements, peak separation is performed—by the curve fitting of the multiple silane components of the toner having different substituents and bonding groups—into the X1 structure, the X2 structure, the X3 structure, the X4 structure, and the T3 structure, and the mol % for each component is calculated from the area ratios for the individual peaks.

In the present invention, the silane structures were discriminated using the chemical shift values, and the total peak area (SS) for the organosilicon polymer was taken to be the sum of the area for the X4 structure plus the area for the X3 structure plus the area for the X2 structure plus the area for the X1 structure with the monomer component eliminated from the total peak area in the $^{29}$Si-NMR measurement of the toner.

$$SX1+SX2+SX3+SX4=1.00$$

SX1={area for the X1 structure/SS}
SX2={area for the X2 structure/SS}
SX3={area for the X3 structure/SS}
SX4={area for the X4 structure/SS}
ST3={area for the T3 structure/SS}

The chemical shift values for silicon for the X1 structure, X2 structure, X3 structure, X4 structure, and T3 structure are given below.

Example for the X1 structure (Ri=Rj=—$OC_2H_5$, Rk=—$CH_3$): −47 ppm

Example for the X2 structure (Rg=—$OC_2H_5$, Rh=—$CH_3$):= 56 ppm

Example for the X3 structure and T3 structure ($R^0$= Rm=—$CH_3$): −65 ppm

The chemical shift value for the silicon in the case of the X4 structure is as follows.

X4 structure: −108 ppm

EXAMPLES

The present invention is more specifically described below using examples. The present invention is not limited to or by the following examples. The "parts" and "%" in the text are on a mass basis unless specifically indicated otherwise.

<Block Polymer 1 Production Example>

100.0 mass parts of xylene was introduced into a reaction vessel fitted with a stirrer, thermometer, nitrogen introduction line, and pressure reduction apparatus and, while undergoing nitrogen substitution, was heated to establish a reflux at a liquid temperature of 140° C. A mixture of 100.0 mass parts of styrene and 8.0 mass parts of dimethyl 2,2'-azobis (2-methylpropionate) was added dropwise to this solvent over 3 hours, and the solution was stirred for 3 hours after the completion of the dropwise addition. This was followed by distillative removal of the xylene and residual styrene at 160° C. and 1 hPa to obtain a vinyl polymer (1).

Then, 0.50 parts of titanium(IV) isopropoxide as an esterification catalyst was added to 100.0 mass parts of the thusly obtained vinyl polymer (1), 80.0 parts of xylene as organic solvent, and 94.7 mass parts of 1,12-dodecanediol in a reaction vessel fitted with a stirrer, thermometer, nitrogen introduction line, water separator, and pressure reduction apparatus and a reaction was run for 4 hours at 150° C. under a nitrogen atmosphere. This was followed by the addition of 84.1 mass parts of sebacic acid and reaction for 3 hours at 150° C. and for 4 hours at 180° C. The reaction was then additionally run at 180° C. and 1 hPa until a weight-average molecular weight (Mw) of 20,000 was reached to obtain block polymer 1.

<Block Polymer 2 Production Example>

A block polymer 2 was obtained proceeding as in the Block Polymer 1 Production Example, but changing the 94.7 mass parts of 1,12-dodecanediol to 81.6 mass parts of 1,10-decanediol.

<Polyester Resin 1 Production Example>

The following polyester monomers terephthalic acid 21.0 mass parts isophthalic acid 21.0 mass parts bisphenol A-propylene oxide (2 mol) adduct 89.5 mass parts bisphenol A-propylene oxide (3 mol) adduct 23.0 mass parts potassium oxalate titanate 0.030 mass parts were introduced into an autoclave fitted with a pressure reduction apparatus, water separation apparatus, nitrogen gas introduction apparatus, temperature measurement apparatus, and stirring apparatus and a reaction was run for 15 hours at 220° C. under a nitrogen atmosphere and at normal pressure followed by a reaction for an additional 1 hour under a reduced pressure of 10 to 20 mmHg to obtain a polyester resin 1. Polyester resin 1 had a glass transition temperature (Tg) of 74.8° C. and an acid value of 8.2 mg KOH/g.

<Polyester Resin 2 Production Example> terephthalic acid 100.0 mass parts bisphenol A-propylene oxide (2 mol) adduct 205.0 mass parts These monomers were introduced into an autoclave along with an esterification catalyst, and a pressure-reduction apparatus, water-separation apparatus, nitrogen gas introduction apparatus, temperature-measurement apparatus, and stirring apparatus were fitted on the autoclave. Using a common method, a reaction was run at 210° C. under a nitrogen atmosphere while reducing the pressure until Tg reached 68.0° C., thereby obtaining polyester resin 2. The weight-average molecular weight (Mw) of polyester resin 2 was 7,500 and its number-average molecular weight (Mn) was 3,000.

<Polyester Resin 3 Production Example> bisphenol A-ethylene oxide (2 mol) adduct 725.0 mass parts phthalic acid 290.0 mass parts dibutyltin oxide 3.0 mass parts These substances were reacted for 7 hours while stirring at 220° C. and were additionally reacted for 5 hours under reduced pressure. This was followed by cooling to 80° C. and reaction for 2 hours with 190.0 mass parts of isophorone diisocyanate in ethyl acetate to obtain an isocyanate group-bearing polyester resin. 25.0 mass parts of this isocyanate group-bearing polyester resin and 1.0 mass parts of isophoronediamine were reacted for 2 hours at 50° C. to obtain a polyester resin 3 in which the main component was a urea group-bearing polyester.

The obtained polyester resin 3 had a weight-average molecular weight (Mw) of 22,200, a number-average molecular weight (Mn) of 2,900, and a peak molecular weight of 7,300.

<Toner 1 Production Example>

700 mass parts of deionized water, 1000 mass parts of a 0.1 mol/liter aqueous $Na_3PO_4$ solution, and 24.0 mass parts of a 1.0 mol/liter aqueous HCl solution were added to a four-neck vessel fitted with a reflux condenser, stirrer, thermometer, and nitrogen introduction line and were held at 60° C. while stirring at 12,000 rpm using a T. K. Homomixer (Tokushu Kika Kogyo Co., Ltd.) high-speed stirrer. To this was gradually added 85 mass parts of a 1.0 mol/liter aqueous $CaCl_2$ solution to prepare an aqueous dispersion containing the microfine, poorly water-soluble dispersion stabilizer $Ca_3(PO_4)_2$.

| | |
|---|---|
| styrene monomer | 78.0 mass parts |
| n-butyl acrylate | 22.0 mass parts |
| block polymer 1 | 6.0 mass parts |
| divinylbenzene | 0.3 mass parts |
| organosilicon compound (methyltriethoxysilane) | 8.0 mass parts |
| copper phthalocyanine pigment (Pigment Blue 15:3) | 6.5 mass parts |
| polyester resin 1 | 5.0 mass parts |
| Bontron E-88 charge control agent (Orient Chemical Industries co., Ltd.) | 0.7 mass parts |
| release agent (behenyl behenate, melting point: 72.1° C.) | 9.0 mass parts |

A polymerizable monomer composition was obtained by dispersing these substances for 3 hours using an Attritor (Mitsui Miike Chemical Engineering Machinery Co., Ltd.), and this polymerizable monomer composition was held for 20 minutes at 60° C. After this, 13.0 mass parts (40% toluene solution) of the polymerization initiator t-butyl peroxypivalate was added to the polymerizable monomer composition, which was then introduced into the aqueous medium and granulated for 10 minutes while maintaining the stirring rate with the high-speed stirrer at 12,000 rpm.

The high-speed stirrer was then changed over to a propeller-stirred container and the internal temperature was raised to 70° C. and a reaction was run for 5 hours while slowly stirring. The pH of the aqueous medium at this point was 5.1.

The pH was then brought to 8.0 by the addition of a 1.0 mol/liter aqueous sodium hydroxide solution, and the temperature within the vessel was raised to 90° C. and holding was carried out for 7.5 hours. This was followed by the addition of 1% hydrochloric acid to bring the pH to 5.1. 300 mass parts of deionized water was added and the reflux condenser was removed and a distillation apparatus was installed. Distillation was performed for 5 hours at a temperature within the vessel of 100° C. The distillate fraction was 300 mass parts. This was followed by cooling to 55° C. and an annealing treatment was carried out for 5 hours at this same temperature. After cooling to 30° C., the dispersion stabilizer was eliminated by the addition of 10% hydrochloric acid. Separation by filtration, washing, and drying then yielded a toner particle 1 having a weight-average particle diameter of 5.8 μm. The obtained toner particle 1 was designated toner 1.

The weight-average molecular weight of the binder resin (copolymer of styrene, n-butyl acrylate, and divinylbenzene) was 100,000 and its glass transition temperature (Tg) was 57° C.

The formulation and conditions for toner 1 are given in Table 1, and its properties are given in Table 2.

Silicon mapping was performed on toner particle 1 by observation with a transmission electron microscope (TEM), and it was confirmed that the silicon atom was uniformly present in the surface layer.

A surface layer containing an organosilicon polymer was also similarly confirmed by silicon mapping in the examples and comparative examples that follow.

A graph showing the viscoelasticity of toner 1 is given in FIG. 1. The solid line in this graph gives the results for the dynamic viscoelastic measurement on the non-melt-molded pellet, while the dashed line gives the results for the dynamic viscoelastic measurement on the melt-molded pellet. In the figure, the arrow pointing to the right refers to the numerical values on the right axis in the graph, while the arrow pointing to the left refers to the numerical values on the left axis in the graph.

<Toners 2 to 6 Production Example>

Toners 2 to 6 were obtained by the same method as used for toner 1, but changing to the formulations and conditions given in Table 1. The formulations and conditions for toners 2 to 6 are given in Table 1, and their properties are given in Table 2.

<Toner 7 Production Example>

A toner particle was obtained by the same method as for toner particle 1, but changing to the formulation and conditions given in Table 1. A toner 7 was obtained by mixing 100 mass parts of this toner particle using a Mitsui Henschel Mixer (Mitsui Miike Chemical Engineering Machinery Co., Ltd.) with 0.50 mass parts of a hydrophobic silica 1 that had a specific surface area by the BET method of 90 $m^2/g$ and that had been subjected to a surface hydrophobing treatment with 3.0 mass % of hexamethyldisilazane and 3 mass % of a 100 cps silicone oil. The formulation and conditions are given in Table 1, and the properties are given in Table 2.

<Toner 8 Production Example>

A toner 8 was obtained by the same method as for toner 7, but changing to the formulation and conditions given in Table 1. The formulation and conditions are given in Table 1, and the properties are given in Table 2.

<Toner 9 Production Example>

| | |
|---|---|
| polyester resin 2 | 60.0 mass parts |
| polyester resin 3 | 40.0 mass parts |
| copper phthalocyanine pigment (Pigment Blue 15:3) | 6.5 mass parts |
| organosilicon compound (methyltriethoxysilane) | 8.0 mass parts |
| Bontron E-88 charge control agent (Orient Chemical Industries Co., Ltd.) | 0.7 mass parts |
| paraffin wax (HNP-5, Nippon Seiro Co., Ltd., melting point = 60° C.) | 9.0 mass parts |

A solution was obtained by dissolving these substances in 400 mass parts of toluene.

700 mass parts of deionized water, 1000 mass parts of a 0.1 mol/liter aqueous $Na_3PO_4$ solution, and 24.0 mass parts of a 1.0 mol/liter aqueous HCl solution were added to a four-neck vessel fitted with a Liebig reflux condenser and were held at 60° C. while stirring at 12,000 rpm using a T. K. Homomixer (Tokushu Kika Kogyo Co., Ltd.) high-speed stirrer. To this was gradually added 85 mass parts of a 1.0 mol/liter aqueous $CaCl_2$ solution to prepare an aqueous dispersion containing the microfine, poorly water-soluble dispersion stabilizer $Ca_3(PO_4)_2$.

100 mass parts of the aforementioned solution was introduced while stirring with a T. K. Homomixer (Tokushu Kika Kogyo Co., Ltd.) at 12,000 rpm and stirring was performed for 5 minutes. This mixture was then held for 5 hours at 70° C. The pH was 5.1. The pH was brought to 8.0 by the addition of a 1.0 mol/liter aqueous sodium hydroxide solution. The temperature was then raised to 90° C. and holding was carried out for 7.5 hours. This was followed by the addition of 1% hydrochloric acid to bring the pH to 5.1. 300 mass parts of deionized water was added and the reflux condenser was removed and a distillation apparatus was installed. Distillation was performed for 5 hours at a temperature within the vessel of 100° C. The distillate fraction was 320 mass parts. This was followed by cooling to 55° C. and an annealing treatment was carried out for 5 hours at this same temperature. After cooling to 30° C., the dispersion stabilizer was eliminated by the addition of 10% hydrochloric acid. Separation by filtration, washing, and drying then yielded a toner particle 9 having a weight-average particle diameter of 5.8 μm. The obtained toner particle 9 was designated toner 9.

The properties of toner 9 are given in Table 2. Silicon mapping was performed on toner particle 9 by TEM observation, and it was confirmed that the silicon atom was uniformly present in the surface layer.

<Toner 10 Production Example>

| | |
|---|---|
| polyester resin 2 | 60.0 mass parts |
| polyester resin 3 | 40.0 mass parts |
| copper phthalocyanine pigment (Pigment Blue 15:3) | 6.5 mass parts |
| Bontron E-88 charge control agent (Orient Chemical Industries Co., Ltd.) | 0.7 mass parts |
| release agent (behenyl behenate, melting point: 72.1° C.) | 9.0 mass parts |

These substances were mixed with a Mitsui Henschel Mixer (Mitsui Miike Chemical Engineering Machinery Co., Ltd.) followed by melt-kneading at 135° C. using a twin-screw kneading extruder, and the kneaded material was then cooled, coarsely pulverized with a cutter mill, pulverized using a micropulverizer that used a jet air flow, and classified using an air classifier to obtain a toner core having a weight-average particle diameter of 5.8 μm.

700 mass parts of deionized water, 1000 mass parts of a 0.1 mol/liter aqueous $Na_3PO_4$ solution, and 24.0 mass parts of a 1.0 mol/liter aqueous HCl solution were added to a four-neck vessel fitted with a Liebig reflux condenser and were held at 60° C. while stirring at 12,000 rpm using a T. K. Homomixer (Tokushu Kika Kogyo Co., Ltd.) high-speed stirrer. To this was gradually added 85 mass parts of a 1.0 mol/liter aqueous $CaCl_2$ solution to prepare an aqueous dispersion medium containing the microfine, poorly water-soluble dispersion stabilizer $Ca_3(PO_4)_2$.

115.0 mass parts of the aforementioned toner core and 8.0 mass parts of methyltriethoxysilane were introduced into this aqueous dispersion medium while stirring with a T. K. Homomixer (Tokushu Kika Kogyo Co., Ltd.) at 5,000 rpm and stirring was performed for 30 minutes. This mixture was then held for 5 hours at 70° C. The pH was 5.1. The pH was brought to 8.0 by the addition of a 1.0 mol/liter aqueous sodium hydroxide solution. The temperature was then raised to 90° C. and holding was carried out for 7.5 hours. This was followed by the addition of 1% hydrochloric acid to bring the pH to 5.1. 300 mass parts of deionized water was added and the reflux condenser was removed and a distillation apparatus was installed. Distillation was performed for 5 hours at a temperature within the vessel of 100° C. The distillate fraction was 320 mass parts. This was followed by cooling to 55° C. and an annealing treatment was carried out for 5 hours at this same temperature. After cooling to 30° C., the dispersion stabilizer was eliminated by the addition of 10% hydrochloric acid. Separation by filtration, washing, and drying then yielded a toner particle 10 having a weight-average particle diameter of 5.8 μm. The obtained toner particle 10 was designated toner 10.

The properties of toner 10 are given in Table 2. Silicon mapping was performed on toner particle 10 by TEM observation, and it was confirmed that the silicon atom was uniformly present in the surface layer.

<Toner 11 Production Example>

"Synthesis of Polyester Resin 4"

| | |
|---|---|
| bisphenol ethylene oxide (2 mol) adduct | 9 mol parts |
| bisphenol A-propylene oxide (2 mol) adduct | 95 mol parts |
| terephthalic acid | 50 mol parts |
| fumaric acid | 30 mol parts |
| dodecenylsuccinic acid | 25 mol parts |

These monomers were introduced into a flask fitted with a stirring apparatus, a nitrogen introduction line, a temperature sensor, and a rectification column, and the temperature was raised to 195° C. in 1 hour and it was confirmed that the interior of the reaction system was being uniformly stirred. Tin distearate at 1.0 mass % with respect to the total mass of these monomers was introduced. The temperature was further raised over 5 hours from 195° C. to 250° C. while distilling out the produced water, and a dehydration condensation reaction was run for an additional 2 hours at 250° C. This resulted in the production of an amorphous polyester resin 4 that had a glass transition temperature of 60.2° C., an acid value of 13.8 mg KOH/g, a hydroxyl value of 28.2 mg KOH/g, a weight-average molecular weight of 14,200, a number-average molecular weight of 4,100, and a softening point of 111° C.

"Synthesis of Polyester Resin 5"

| | |
|---|---|
| bisphenol A-ethylene oxide (2 mol) adduct | 48 mol parts |
| bisphenol A-propylene oxide (2 mol) adduct | 48 mol parts |
| terephthalic acid | 65 mol parts |
| dodecenylsuccinic acid | 30 mol parts |

These monomers were introduced into a flask fitted with a stirring apparatus, a nitrogen introduction line, a temperature sensor, and a rectification column, and the temperature was raised to 195° C. in 1 hour and it was confirmed that the interior of the reaction system was being uniformly stirred. Tin distearate at 0.7 mass % with respect to the total mass of these monomers was introduced. The temperature was further raised over 5 hours from 195° C. to 240° C. while distilling out the produced water, and a dehydration condensation reaction was run for an additional 2 hours at 240° C. The temperature was then dropped to 190° C. and 5 mol parts of trimellitic anhydride was gradually introduced and the reaction was continued for 1 hour at 190° C. This resulted in the production of a polyester resin 5 that had a glass transition temperature of 55.2° C., an acid value of 14.3 mg KOH/g, a hydroxyl value of 24.1 mg KOH/g, a weight-average molecular weight of 53,600, a number-average molecular weight of 6,000, and a softening point of 108° C.

"Preparation of Resin Particle Dispersion 1"

| | |
|---|---|
| polyester resin 4 | 100 mass parts |
| methyl ethyl ketone | 50 mass parts |
| isopropyl alcohol | 20 mass parts |

The methyl ethyl ketone and isopropyl alcohol were introduced into a vessel. After this, the resin was gradually introduced and stirring was carried out and complete dissolution was brought about to obtain a polyester resin 4 solution. The vessel containing this polyester resin 4 solution was set to 65° C.; a 10% aqueous ammonia solution was gradually added dropwise while stirring so as to provide a total of 5 mass parts; and 230 mass parts of deionized water was gradually added dropwise at a rate of 10 mL/minute and a phase inversion emulsification was carried out. Using an evaporator, the pressure was reduced and solvent elimination was performed to obtain a resin particle dispersion 1 of the polyester resin 4. The volume-average particle diameter of the resin particles was 135 nm. The resin particle solids fraction was brought to 20% by adjustment with deionized water.

"Preparation of Resin Particle Dispersion 2"

| | |
|---|---|
| polyester resin 5 | 100 mass parts |
| methyl ethyl ketone | 50 mass parts |
| isopropyl alcohol | 20 mass parts |

The methyl ethyl ketone and isopropyl alcohol were introduced into a vessel. After this, the aforementioned material was gradually introduced and stirring was carried out and complete dissolution was brought about to obtain a polyester resin 5 solution. The vessel containing this polyester resin 5 solution was set to 40° C.; a 10% aqueous ammonia solution was gradually added dropwise while stirring so as to provide a total of 3.5 mass parts; and 230 mass parts of deionized water was gradually added dropwise at a rate of 10 mL/minute and a phase inversion emulsification was carried out. The pressure was reduced and solvent elimination was performed to obtain a resin particle dispersion 2 of the polyester resin 5. The volume-average particle diameter of the resin particles was 155 nm. The resin particle solids fraction was brought to 20% by adjustment with deionized water.

"Preparation of a Sol-gel Solution of Resin Particle Dispersion 1"

20.0 mass parts of methyltriethoxysilane was added to 100 mass parts (20 mass parts solids fraction) of resin particle dispersion 1; holding was performed for 1 hour at 70° C. while stirring; and the temperature was then raised at a ramp rate of 20° C./1 hour and holding was performed for 3 hours at 95° C. This was followed by cooling to obtain a sol-gel solution of the resin particle dispersion 1, in which the resin fine particles were coated with a sol-gel. The volume-average particle diameter of these resin particles was 210 nm. The resin particle solids fraction was brought to 20% by adjustment with deionized water. The sol-gel solution of resin particle dispersion 1 was held at 10° C. or below while stirring and was used within 48 hours after preparation. The particle surface is preferably in a high-viscosity sol or gel state because this provides an excellent particle-to-particle adherence.

"Preparation of Colorant Particle Dispersion"

| | |
|---|---|
| copper phthalocyanine (Pigment Blue 153) | 45 mass parts |
| Neogen RK ionic surfactant (DKS Co. Ltd.) | 5 mass parts |
| deionized water | 190 mass parts |

These components were mixed and were dispersed for 10 minutes using a homogenizer (Ultra-Turrax, IKA® Werke GmbH & Co. KG). This was followed by dispersion processing for 20 minutes at a pressure of 250 MPa using an Altimizer (countercurrent collision wet pulverizer: from Sugino Machine Limited) to obtain a colorant particle dispersion having a solids fraction of 20% and a volume-average particle diameter for the colorant particles of 120 nm.

"Preparation of a Release Agent Particle Dispersion"

| | |
|---|---|
| olefin wax (melting point: 84° C.) | 60 mass parts |
| Neogen RK ionic surfactant (DKS Co. Ltd.) | 2 mass parts |
| deionized water | 240 mass parts |

The preceding were heated to 100° C. and thoroughly dispersed in an Ultra-Turrax T50 from IKA® Werke GmbH & Co. KG and subsequently subjected to dispersion processing, using a pressure ejection-type Gaulin homogenizer, for 1 hour heated to 115° C. to obtain a release agent particle dispersion having a solids fraction of 20% and a volume-average particle diameter of 160 nm.

"Toner Particle 11 Production"

| | |
|---|---|
| resin particle dispersion 1 | 500 mass parts |
| resin particle dispersion 2 | 400 mass parts |
| colorant particle dispersion | 50 mass parts |
| release agent particle dispersion | 50 mass parts |

After the addition of 2.2 mass parts of Neogen RK ionic surfactant, the materials listed above were stirred in a flask. The pH was subsequently brought to 3.7 by the dropwise addition of a 1 mol/liter aqueous nitric acid solution and 0.35 mass parts of polyaluminum sulfate was then added and dispersion was carried out using an Ultra-Turrax from IKA® Werke GmbH & Co. KG. Heating to 50° C. was performed while stirring the flask on a hot oil bath. After holding for 40 minutes at 50° C., 100 mass parts of the sol-gel solution of resin particle dispersion 1 mixture was gently added.

The pH within the system was subsequently brought to 7.0 by the addition of a 1 mol/liter aqueous sodium hydroxide solution; the stainless steel flask was sealed; and, while continuing to stir, gradual heating to 90° C. was carried out and holding for 5 hours at 90° C. was performed. Additional holding for 7.5 hours at 95° C. was also carried out.

2.0 mass parts of Neogen RK ionic surfactant was then added and a reaction was run for 5 hours at 100° C. After the completion of the reaction, a 320 mass parts fraction was recovered at 85° C. by reduced-pressure distillation. This was followed by cooling to 55° C. and the execution of an annealing treatment for 5 hours at the same temperature. This was followed by cooling, filtration, and drying. Redispersion in 5 L of 40° C. deionized water was carried out and stirring with a stirring blade (300 rpm) for 15 minutes and then filtration were performed.

This washing by redispersion and filtration was repeated, and washing was ended when the electrical conductivity reached 6.0 μS/cm or less to yield the toner particle 11. The obtained toner particle 11 was designated toner 11. The properties of toner 11 are given in Table 2. Silicon mapping was performed in the TEM observation of toner particle 11, and it was confirmed that the silicon atom was uniformly present in the surface layer.

<Comparative Toners 1 and 2 Production Example>

Comparative toners 1 and 2 were obtained by the same method as for toner 1, but changing to the formulation and conditions given in Table 1. The formulation and conditions for comparative toners 1 and 2 are given in Table 1, and the properties are given in Table 2.

<Comparative Toner 3 Production Example>

700 mass parts of deionized water, 1000 mass parts of a 0.1 mol/liter aqueous $Na_3PO_4$ solution, and 24.0 mass parts of a 1.0 mol/liter aqueous HCl solution were added to a four-neck vessel fitted with a reflux condenser, stirrer, thermometer, and nitrogen introduction line and were held at 60° C. while stirring at 12,000 rpm using a T. K. Homomixer (Tokushu Kika Kogyo Co., Ltd.) high-speed stirrer. To this was gradually added 85 mass parts of a 1.0 mol/liter aqueous $CaCl_2$ solution to prepare an aqueous dispersion medium containing the microfine, poorly water-soluble dispersion stabilizer $Ca_3(PO_4)_2$.

| | |
|---|---|
| styrene monomer | 78.0 mass parts |
| n-butyl acrylate | 22.0 mass parts |
| divinylbenzene | 0.2 mass parts |
| copper phthalocyanine pigment (Pigment Blue 15:3) | 6.5 mass parts |
| polyester resin 1 | 5.0 mass parts |
| Bontron E-88 charge control agent (Orient Chemical Industries Co., Ltd.) | 0.7 mass parts |
| release agent (behenyl behenate, melting point: 72.1° C.) | 9.0 mass parts |

A polymerizable monomer composition was obtained by dispersing these substances for 3 hours using an Attritor (Mitsui Miike Chemical Engineering Machinery Co., Ltd.), and this polymerizable monomer composition was held for 20 minutes at 60° C. After this, 13.0 mass parts (40% toluene solution) of the polymerization initiator t-butyl peroxypivalate was added to the polymerizable monomer composition, which was then introduced into the aqueous medium and granulated for 10 minutes while maintaining the stirring rate with the high-speed stirrer at 12,000 rpm.

The high-speed stirrer was then changed over to a propeller-stirred container and the internal temperature was raised to 70° C. and a reaction was run for 5 hours while slowly stirring. The pH of the aqueous medium at this point was 5.1.

The temperature within the vessel was raised to 90° C. and holding was carried out for 1.5 hours. 300 mass parts of deionized water was then added and the reflux condenser was removed and a distillation apparatus was installed. Distillation was performed for 5 hours at a temperature within the vessel of 100° C. The distillate fraction was 300 mass parts. This was followed by cooling to 55° C. and an annealing treatment was carried out for 5 hours at this same temperature. After cooling to 30° C., the dispersion stabilizer was eliminated by the addition of 10% hydrochloric acid. Separation by filtration, washing, and drying then yielded a toner particle having a weight-average particle diameter of 5.8 μm.

A comparative toner 3 was obtained by mixing 100 mass parts of this toner particle using a Mitsui Henschel Mixer (Mitsui Miike Chemical Engineering Machinery Co., Ltd.) with 1.80 mass parts of a hydrophobic silica 1 that had a specific surface area by the BET method of 90 $m^2/g$ and that had been subjected to a surface hydrophobing treatment with 3.0 mass % of hexamethyldisilazane and 3 mass % of a 100 cps silicone oil. The formulation and conditions for comparative toner 3 are given in Table 1, and the properties are given in Table 2.

TABLE 1

| Toner No. | | 1 | 2 | 3 | 4 | 5 | 6 | 7 | 8 |
|---|---|---|---|---|---|---|---|---|---|
| polymerizable monomer | styrene (mass parts) | 78.0 | 78.0 | 78.0 | 78.0 | 75.0 | 73.0 | 78.0 | 78.0 |
| | n-butyl acrylate (mass parts) | 22.0 | 22.0 | 22.0 | 22.0 | 25.0 | 27.0 | 22.0 | 22.0 |
| | divinyl benzene (mass parts) | 0.3 | 0.3 | 0.35 | 0.3 | 0.1 | 0.1 | 0.3 | 0.3 |
| organo silicon compound | methyl triethoxy silane (mass parts) | 8.0 | 8.0 | 8.0 | 8.0 | 10.0 | 10.0 | 6.0 | 5.0 |
| resin | polyester resin 1 (mass parts) | 5.0 | 5.0 | 5.0 | 5.0 | 5.0 | 5.0 | 5.0 | 5.0 |
| | block polymer 1 (mass parts) | 6.0 | 0 | 0 | 0 | 0 | 0 | 6.0 | 6.0 |
| | block polymer 2 (mass parts) | 0 | 6.0 | 6.0 | 0 | 6.0 | 0 | 0 | 0 |
| release agent | behenyl behenate (mass parts) | 9.0 | 9.0 | 9.0 | 9.0 | 9.0 | 9.0 | 9.0 | 9.0 |
| charge control agent | Bontron E-88 (mass parts) | 0.7 | 0.7 | 0.7 | 0.7 | 0.7 | 0.7 | 0.7 | 0.7 |
| colorant | Pigment Blue 15:3 (mass parts) | 6.5 | 6.5 | 6.5 | 6.5 | 6.5 | 6.5 | 6.5 | 6.5 |
| polymerization initiator | t-butyl peroxy pivalate (mass parts) | 13.0 | 13.0 | 15.0 | 13.0 | 13.0 | 13.0 | 13.0 | 13.0 |
| external additive | hydrophobic silica 1 (mass parts) | — | — | — | — | — | — | 0.50 | 0.75 |
| annealing conditions | | 55° C. 5 hr | 55° C. 5 hr | 55° C. 5 hr | 55° C. 5 hr | 55° C. 1 hr | 55° C. 1 hr | 55° C. 5 hr | 55° C. 5 hr |
| binder resin | glass transition temperature (° C.) | 57 | 57 | 58 | 57 | 54 | 52 | 57 | 57 |
| | weight-average molecular weight (Mw) | 100000 | 110000 | 120000 | 115000 | 54300 | 55500 | 110000 | 110000 |

| Toner No. | | 9 | 10 | 11 | comparative 1 | comparative 2 | comparative 3 |
|---|---|---|---|---|---|---|---|
| polymerizable monomer | styrene (mass parts) | described in text | described in text | described in text | 70.0 | 78.0 | 78.0 |
| | n-butyl acrylate (mass parts) | | | | 30.0 | 22.0 | 22.0 |

TABLE 1-continued

| | | | | | | | |
|---|---|---|---|---|---|---|---|
| | divinyl benzene (mass parts) | | | | 0 | 0.6 | 0.2 |
| organo silicon compound | methyl triethoxy silane (mass parts) | | | | 10.0 | 8.0 | 0 |
| resin | polyester resin 1 (mass parts) | | | | 5.0 | 5.0 | 5.0 |
| | block polymer 1 (mass parts) | | | | 0 | 0 | 0 |
| | block polymer 2 (mass parts) | | | | 0 | 0 | 0 |
| release agent | behenyl behenate (mass parts) | | | | 9.0 | 9.0 | 9.0 |
| charge control agent | Bontron E-88 (mass parts) | | | | 0.7 | 0.7 | 0.7 |
| colorant | Pigment Blue 15:3 (mass parts) | | | | 6.5 | 6.5 | 6.5 |
| polymerization initiator | t-butyl peroxy pivalate (mass parts) | | | | 13.0 | 10.0 | 13.0 |
| external additive | hydro-phobic silica 1 (mass parts) | | | | — | — | 1.80 |
| annealing conditions | | | | | — | 55° C. 5 hr | 55° C. 5 hr |
| binder resin | glass transition temperature (° C.) | 61 | 59 | 58 | 49 | 58 | 57 |
| | weight-average molecular weight (Mw) | 20500 | 19400 | 45200 | 44000 | 253000 | 86000 |

TABLE 2

| Toner properties | | toner 1 | toner 2 | toner 3 | toner 4 | toner 5 | toner 6 | toner 7 |
|---|---|---|---|---|---|---|---|---|
| particle diameter | D4 (μm) | 5.8 | 5.6 | 5.6 | 5.6 | 5.7 | 5.5 | 5.6 |
| | D1 (μm) | 5.4 | 5.3 | 5.2 | 5.2 | 5.3 | 5.2 | 5.3 |
| [a/b] | | 0.98 | 0.96 | 0.96 | 0.98 | 0.85 | 0.85 | 0.98 |
| visco elasticity | temperature range A (° C.) | 118-160 | 122-160 | 145-160 | 122-160 | 111-160 | 90-160 | 126-160 |
| | temperature rangeB (° C.) | 118-160 | 122-160 | 145-160 | 122-160 | 111-160 | 90-160 | 126-160 |
| | temperature rangeC (° C.) | 88-117 | 87-121 | 88-144 | 94-121 | 94-110 | none | 94-125 |
| | area A | 3.22 | 5.45 | 26.20 | 1.38 | 0.70 | 0 | 3.05 |
| surface uniformity | σRSm/RSm | 0.45 | 0.60 | 0.55 | 0.46 | 0.60 | 0.30 | 0.76 |
| | RSm (nm) | 125 | 130 | 130 | 150 | 135 | 480 | 180 |
| T3 percentage | ST3 (%) | 70.0 | 64.0 | 60.0 | 65.0 | 31.0 | 24.0 | 56.0 |
| degree of crystallinity (%) | | 97 | 97 | 97 | 97 | 85 | 85 | 98 |

| Toner properties | | toner 8 | toner 9 | toner 10 | toner 11 | comparative toner 1 | comparative toner 2 | comparative toner 3 |
|---|---|---|---|---|---|---|---|---|
| particle diameter | D4 (μm) | 5.8 | 5.8 | 5.8 | 5.7 | 5.5 | 5.8 | 5.8 |
| | D1 (μm) | 5.3 | 5.3 | 5.2 | 5.2 | 5.1 | 5.3 | 5.3 |
| [a/b] | | 0.98 | 0.98 | 0.97 | 0.98 | 0.83 | 0.95 | 0.95 |
| visco elasticity | temperature rangeA (° C.) | 126-160 | 117-160 | 112-160 | 118-160 | 88-160 | 88-160 | none |
| | temperature rangeB (° C.) | 126-160 | 117-160 | 112-160 | 118-160 | 88-160 | none | 88-160 |

TABLE 2-continued

| | | | | | | | | |
|---|---|---|---|---|---|---|---|---|
| | temperature rangeC (° C.) | 94-125 | 89-116 | 85-111 | 89-117 | none | none | none |
| | area A | 3.01 | 3.86 | 3.62 | 3.77 | 0 | 0 | 0 |
| surface uniformity | σRSm/RSm | 0.85 | 0.55 | 0.72 | 0.58 | 0.61 | 0.57 | 1.01 |
| | RSm (nm) | 190 | 145 | 140 | 150 | 150 | 150 | 101 |
| T3 percentage | ST3 (%) | 48.0 | 68.0 | 67.0 | 67.0 | 19.0 | 65.0 | 2.0 |
| degree of crystallinity (%) | | 97 | 98 | 97 | 98 | 82 | 95 | 95 |

<Toner Evaluations>

[Image Dropout]

An LBP9600C laser beam printer from Canon, Inc. was modified to enable adjustment of the fixation temperature in the fixing unit. Using this modified LBP9600C and operating at a process speed of 300 mm/s in a normal-temperature, normal-humidity environment (25° C./50% RH), a fixed image was formed on image-receiving paper by the oilless application under heat and pressure of an unfixed toner image with a toner laid-on level of 0.90 mg/cm$^2$ to the image-receiving paper, with the fixation temperature being reduced here from 170° C. in 5° C. steps. The presence/absence of image dropout was then visually checked and evaluated. A score of C or better is an acceptable level for the present invention.

(Evaluation Criteria)

A: no image dropout at 155° C.

B: image dropout is produced at 155° C.

C: image dropout is produced at 160° C.

D: image dropout is produced at 165° C.

E: image dropout is produced at 170° C.

[Low-Temperature Fixability]

An LBP9600C laser beam printer from Canon, Inc. was modified to enable adjustment of the fixation temperature in the fixing unit. Using this modified LBP9600C and operating at a process speed of 300 mm/s in a normal-temperature, normal-humidity environment (25° C./50% RH), a fixed image was formed on image-receiving paper by the oilless application under heat and pressure of an unfixed toner image with a toner laid-on level of 0.40 mg/cm$^2$ to the image-receiving paper, with the fixation temperature being changed here in 5° C. steps. To evaluate the low-temperature fixability, the fixed image was rubbed 10 times with a Kimwipe [S-200 (Nippon Paper Crecia Co., Ltd.)] under a load of 75 g/cm$^2$, and the low-temperature fixability was evaluated based on the lowest temperature that provided a density reduction percentage pre-versus-post-rubbing of less than 5%. A score of C or better is an acceptable level for the present invention.

(Evaluation Criteria)

A: 140° C. or below

B: 145° C.

C: 150° C.

D: 155° C. or above

[Gloss]

A solid image (toner laid-on level: 0.6 mg/cm$^2$) was output at a fixation temperature of 180° C. and its gloss value was measured using a PG-3D (Nippon Denshoku Industries Co., Ltd.). Letter size plain paper (XEROX 4200 Paper, Xerox Corporation, 75 g/m$^2$) was used as the transfer material.

A score of D or better is an acceptable level for the present invention.

(Evaluation Criteria)

A: gloss value of at least 30

B: gloss value of at least 25 and less than 30

C: gloss value of at least 20 and less than 25

D: gloss value of at least 15 and less than 20

E: gloss value of less than 15

[Durability]

Image evaluation was performed using a commercial color laser printer (HP Color LaserJet 3525dn). 300 g of the toner was filled into a toner cartridge. This toner cartridge was held for 24 hours in a normal-temperature, normal-humidity environment (N/N, 25° C./50% RH). A 35,000-print print-out test was then run in the same environment using a horizontal line image with a print percentage of 1%. After the completion of this test, a halftone (toner laid-on level: 0.6 mg/cm$^2$) image was printed out on letter size plain paper (XEROX 4200 Paper, Xerox Corporation, 75 g/m$^2$), and the durability was evaluated based on the extent of development streak production. A score of C or better is an acceptable level for the present invention.

(Evaluation Criteria)

A: development streak production does not occur

B: development streak production occurs at at least 1 to not more than 3 locations C: development streaks are produced at at least 4 to no more than 6 locations D: development streaks are produced at 7 or more locations, or a development streak with a width of 0.5 mm or greater is produced Examples 1 to 11

The evaluations were performed using toners 1 to 11, respectively, in Examples 1 to 11. The results of the evaluations are given in Table 3.

Comparative Examples 1 to 3

The evaluations were performed using comparative toners 1 to 3, respectively, in Comparative Examples 1 to 3. The results of the evaluations are given in Table 3.

TABLE 3

| Example | toner No. | image dropout | low-temperature fixability | gloss | durability |
|---|---|---|---|---|---|
| Example 1 | 1 | A | A | A(33) | A(0) |
| Example 2 | 2 | A | A | A(36) | A(0) |
| Example 3 | 3 | A | A | A(40) | A(0) |
| Example 4 | 4 | B | C | C(24) | A(0) |
| Example 5 | 5 | C | B | C(22) | C(5) |
| Example 6 | 6 | C | B | D(16) | C(4) |
| Example 7 | 7 | B | B | B(29) | B(1) |
| Example 8 | 8 | C | B | B(28) | B(3) |
| Example 9 | 9 | A | B | A(31) | B(1) |
| Example 10 | 10 | A | B | A(32) | B(1) |
| Example 11 | 11 | A | B | A(31) | B(1) |
| Comparative Example 1 | comparative 1 | E | B | C(20) | C(5) |

TABLE 3-continued

| Example | toner No. | image dropout | low-temperature fixability | gloss | durability |
|---|---|---|---|---|---|
| Comparative Example 2 | comparative 2 | D | D | E(7) | C(6) |
| Comparative Example 3 | compatative 3 | E | D | A(31) | D(10) |

The present invention can provide a toner in which an increased gloss co-exists with a suppression of image dropout.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-084001, filed Apr. 19, 2016, which is hereby incorporated by reference herein in its entirety.

What is claimed is:

1. A toner comprising a toner particle containing:

a binder resin and a crystalline material;

the toner particle having a surface layer comprising an organosilicon polymer, wherein a/b≥0.85 when "a" is an endothermic quantity deriving from the crystalline material in a differential scanning calorimetric measurement of the toner and "b" is an endothermic quantity deriving from the crystalline material in a differential scanning calorimetric measurement of the toner that has been held for 10 hours in an environment with a temperature of 55° C. and a humidity of 8% RH, in a dynamic viscoelastic measurement of a non-melt-molded pellet of the toner measured using a rotational parallel plate rheometer in temperature sweep mode in a temperature range of 50° C. to 160° C. at a temperature ramp rate of 2.0° C./minute and an oscillation frequency of 1.0 Hz (6.28 rad/s), the toner has a temperature range A for which $G'' \leq 1\times10^5$ Pa and tan δ<1 are satisfied, and in the dynamic viscoelastic measurement of a melt-molded pellet of the toner formed by (i) providing a sample by compression molding the toner into a circular disk with a diameter of 7.9 mm and a thickness of 2.0±0.3 mm using a tablet molder in a 25° C. environment, (ii) placing the sample in the parallel plates, (iii) raising the temperature of the sample placed in the parallel plates from 25° C. to 120° C., (iv) holding the temperature of the sample at 120° C. for 1 minute while displacing the parallel plates between which the sample is placed up-to-down in 5 back-and-forth excursions at an amplitude of 1 cm, and (v) trimming the shape of the sample, the toner has a temperature range B for which tan δ>1 is satisfied within the temperature range A.

2. The toner according to claim 1, wherein in the dynamic viscoelastic measurement of the non-melt-molded pellet of the toner, the toner has a temperature range C for which $G'' \leq 1\times10^5$ Pa and tan δ>1 are satisfied at temperatures that are lower than the highest temperature in the temperature range A.

3. The toner according to claim 2, wherein in the temperature range C, an area A of a region bounded by a straight line for tan δ=1 and a loss tangent curve obtained in the dynamic viscoelastic measurement of the non-melt-molded pellet of the toner is at least 3.00.

4. The toner according to claim 1, wherein a/b>0.95.

5. A toner comprising a toner particle containing:

a binder resin and a crystalline material the toner particle having a surface layer comprising an organosilicon polymer, wherein a degree of crystallinity of the crystalline material as determined from a differential scanning calorimetric measurement of the toner is at least 85%, in a dynamic viscoelastic measurement of a non-melt-molded pellet of the toner measured using a rotational parallel plate rheometer in temperature sweep mode in a temperature range of 50° C. to 160° C. at a temperature ramp rate of 2.0° C./minute and an oscillation frequency of 1.0 Hz (6.28 rad/s), the toner has a temperature range A for which $G'' \leq 1\times10^5$ Pa and tan δ<1 are satisfied, and in the dynamic viscoelastic measurement of a melt-molded pellet of the toner formed by (i) providing a sample by compression molding the toner into a circular disk with a diameter of 7.9 mm and a thickness of 2.0±0.3 mm using a tablet molder in a 25° C. environment, (ii) placing the sample in the parallel plates, (iii) raising the temperature of the sample placed in the parallel plates from 25° C. to 120° C., (iv) holding the temperature of the sample at 120° C. for 1 minute while displacing the parallel plates between which the sample is placed up-to-down in 5 back-and-forth excursions at an amplitude of 1 cm, and (v) trimming the shape of the sample, the toner has a temperature range B for which tan δ>1 is satisfied within the temperature range A.

6. The toner according to claim 5, wherein in the dynamic viscoelastic measurement of the non-melt-molded pellet of the toner, the toner has a temperature range C for which $G'' \leq 1\times10^5$ Pa and tan δ>1 are satisfied at temperatures that are lower than the highest temperature in the temperature range A.

7. The toner according to claim 6, wherein in the temperature range C, an area A of a region bounded by a straight line for tan δ=1 and a loss tangent curve obtained in the dynamic viscoelastic measurement of the non-melt-molded pellet of the toner is at least 3.00.

8. The toner according to claim 5, wherein the degree of crystallinity of the crystalline material as determined by a differential scanning calorimetric measurement of the toner is at least 95%.

* * * * *